US009799941B2

(12) United States Patent
Liu et al.

(10) Patent No.: US 9,799,941 B2
(45) Date of Patent: Oct. 24, 2017

(54) HARMONIC OSCILLATOR AND PREPARATION METHOD THEREOF, FILTERING DEVICE AND ELECTROMAGNETIC WAVE DEVICE

(71) Applicant: KUANG-CHI INNOVATIVE TECHNOLOGY LTD., Shenzhen (CN)

(72) Inventors: Ruopeng Liu, Shenzhen (CN); Guanxiong Xu, Shenzhen (CN); Jingjing Liu, Shenzhen (CN); Yuhai Ren, Shenzhen (CN); Ning Xu, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 280 days.

(21) Appl. No.: 14/568,137

(22) Filed: Dec. 12, 2014

(65) Prior Publication Data

US 2015/0097639 A1 Apr. 9, 2015

Related U.S. Application Data

(63) Continuation of application No. PCT/CN2013/080757, filed on Aug. 2, 2013.

(30) Foreign Application Priority Data

Aug. 3, 2012 (CN) ..... 2012 1 0272372
Aug. 3, 2012 (CN) ..... 2012 1 0275338
(Continued)

(51) Int. Cl.
*H01P 1/20* (2006.01)
*H01P 7/10* (2006.01)
*H01P 11/00* (2006.01)

(52) U.S. Cl.
CPC ..... *H01P 7/10* (2013.01); *H01P 1/2002* (2013.01); *H01P 11/007* (2013.01); *H01P 11/008* (2013.01); *Y10T 29/49016* (2015.01)

(58) Field of Classification Search
CPC ..... H01P 7/10; H01P 1/2002; H01P 11/007; H01P 11/008
(Continued)

(56) References Cited

U.S. PATENT DOCUMENTS

2010/0301971 A1* 12/2010 Yonak ..... H01P 1/20381 333/219.1

FOREIGN PATENT DOCUMENTS

CN 1490932 A 4/2004
CN 102610924 A 7/2012
(Continued)

*Primary Examiner* — Robert Pascal
*Assistant Examiner* — Kimberly Glenn
(74) *Attorney, Agent, or Firm* — Perkins Coie LLP

(57) ABSTRACT

The disclosure relates to a harmonic oscillator and a preparation method thereof, a filtering device and an electromagnetic wave device. The harmonic oscillator includes at least one dielectric slab and response units attached on one surface of the at least one dielectric slab, where the response units are structures manufactured by conductive material and provided with geometric patterns. According to the technical solution of the disclosure, the filtering device and the electromagnetic wave device with the harmonic oscillator are good in structure stability. Swinging of a harmonic oscillator sheet layer is low in loss. The Q value of the harmonic oscillator prepared by the disclosure is high; and loss of a resonant cavity, the filtering device and a microwave device with the harmonic oscillator is obviously reduced.

19 Claims, 16 Drawing Sheets

(30) Foreign Application Priority Data

Nov. 20, 2012 (CN) ..... 2012 1 0472115
Nov. 20, 2012 (CN) ..... 2012 1 0472217

(58) Field of Classification Search
USPC ..... 333/202
See application file for complete search history.

(56) References Cited

FOREIGN PATENT DOCUMENTS

| | | | |
|---|---|---|---|
| CN | 102904000 | A | 1/2013 |
| CN | 103022623 | A | 4/2013 |
| CN | 103022625 | A | 4/2013 |

* cited by examiner

HARMONIC OSCILLATOR AND PREPARATION METHOD THEREOF, FILTERING DEVICE AND ELECTROMAGNETIC WAVE DEVICE

CROSS REFERENCE TO RELATED APPLICATIONS

This application is a continuation of PCT/CN2013/080757 filed on Aug. 2, 2013, which claims priority to CN 201210275338.9 filed Aug. 3, 2012; CN 201210275372.6 filed Aug. 3, 2012; CN 201210472115.1 filed Nov. 20, 2012; and CN 201210472217.3 filed Nov. 20, 2012; all of which are incorporated herein by reference.

TECHNICAL FIELD

The disclosure relates to the field of microwave radio frequency components and more particular to a harmonic oscillator and a preparation method thereof, a filtering device and an electromagnetic wave device. The filtering device in the disclosure may also be called as a microwave device. The electromagnetic wave device may also be called as communication device or microwave device.

BACKGROUND

A harmonic oscillator, also called as a dielectric resonator, is high in dielectric constant and low in electromagnetic loss, and thus is widely used in various microwave radio frequency devices such as filters, duplexers, and the like. In general, the harmonic oscillator is cylindrical and is formed by integrally sintering the microwave dielectric ceramics. In a resonant cavity of a microwave device such as a filter, a duplexer and the like, a support base is generally arranged at the bottom of the harmonic oscillator and fixed with respect to the resonant cavity. In order to fix the harmonic oscillator, the harmonic oscillator is directly attached to the surface of the support base in general.

In addition, although the microwave dielectric ceramic is high in dielectric constant, low in electromagnetic loss and high tolerance power and the like and conforms to the requirement of the harmonic oscillator, the miniaturization demand of the filter and the duplexer of the people is further increasing with the technological development, the continuous improvement of the product integration. In the related art, the size of the cavity filter or the dubplex is inversely proportional to a resonant frequency. If the size of the resonant cavity is directly reduced, the corresponding resonant frequency is increased, as a result, the filtering function of the filter may not be met. At present, the problem to be urgently solved by the research staffs commonly is about how to realize miniaturization without affecting the normal using function of the cavity filter and the duplexer.

SUMMARY

One purpose of the disclosure is to provide a harmonic oscillator, a microwave device and a communication device with fixed structure and low loss on account of the above defects of the prior art.

The technical solution used by the disclosure for solving the technical problem is to structure a harmonic oscillator. The harmonic oscillator includes a plurality of harmonic oscillator sheet layers with through holes and also includes a connection part penetrated through the through holes of each harmonic oscillator sheet layer in order to string the plurality of harmonic oscillator sheet layers together.

In the harmonic oscillator of the disclosure, the connection part includes a bolt penetrated through the through holes and a nut connected to the end of the bolt.

In the harmonic oscillator of the disclosure, the nut and the bolt are fixedly connected together by welding or hot pressing.

In the harmonic oscillator of the disclosure, the connection part is manufactured by a material with a dielectric constant less than 10 and a loss angle tangent value less than 0.1.

In the harmonic oscillator of the disclosure, the material of the connection part is polyetherimide or Teflon.

In the harmonic oscillator of the disclosure, the harmonic oscillator sheet layers take a shape of ring with a through hole in the middle thereof. The plurality of harmonic oscillator sheet layers is the same in shape and is stacked in turn to form a shape of a hollow cylinder.

In the harmonic oscillator of the disclosure, the harmonic oscillator sheet layer includes a substrate and at least one artificial microstructure attached on the substrate. The artificial microstructures are plane structures manufactured by conductive material and provided with geometric figures.

In the harmonic oscillator of the disclosure, the artificial microstructures are arranged at the edges of the substrate.

In the harmonic oscillator of the disclosure, a plurality of artificial microstructures is arranged in pairs. Each artificial microstructure pair is uniformly distributed by taking a circle center of a ring-shaped harmonic oscillator sheet layer surface as a circle center; and each artificial microstructure pair includes two identical artificial microstructures arranged in parallel.

In the harmonic oscillator of the disclosure, the artificial microstructure is a solid metal foil or a hollow metal foil with a plurality of holes.

The disclosure also relates to a microwave device for treating microwave; the microwave device is provided with at least one resonant cavity; and the harmonic oscillator is arranged in the resonant cavity.

In the microwave device of the disclosure, the microwave device is a cavity filter or a duplexer.

The disclosure also relates to a communication device. The communication device includes the microwave device for treating the microwave.

In the communication device of the disclosure, the communication device is a satellite, a base station, radar, or an aircraft.

The implementation of the harmonic oscillator, the microwave device and the communication device of the disclosure has the following beneficial effect that the harmonic oscillator sheet layers are strung and fixed by the connection part, so that the microwave device and the communication device with the harmonic oscillator are good in structure stability, thus swinging of the harmonic oscillator sheet layers causes low loss.

Another purpose of the disclosure is to provide a harmonic oscillator, a microwave device and a communication device with fixed structure and low loss on account of the defects of the prior art.

The technical solution used by the disclosure for solving the technical problem is to structure a harmonic oscillator. The harmonic oscillator includes a dielectric body and a support base positioned at the bottom of the dielectric body; the dielectric body includes a plurality of harmonic oscillator sheet layers with through holes and a connection part penetrated through the through holes of each harmonic oscillator sheet layer in turn and connected with the support base so as to fixedly connect the dielectric body and the supporting base integrally.

In the harmonic oscillator of the disclosure, the support base is provided with a thread hole; the connection part is a bolt; and the bolt is penetrated through the through holes of each harmonic oscillator sheet layer, assembled and locked with the thread hole of the support base.

In the harmonic oscillator of the disclosure, the support base is provided with a through hole; the connection part includes a bolt and a nut; and the bolt is assembled and locked with the nut after penetrating through the harmonic oscillator sheet layers and the through hole of the support base in turn.

In the harmonic oscillator of the disclosure, the connection part is manufactured by a material with a dielectric constant less than 10 and a loss angle tangent value less than 0.1.

In the harmonic oscillator of the disclosure, the material of the connection part is polyetherimide or Teflon.

In the harmonic oscillator of the disclosure, the harmonic oscillator sheet layers take a shape of ring with a through hole in the middle thereof. The plurality of harmonic oscillator sheet layers is the same in shape and is stacked in turn to form a shape of a hollow cylinder.

In the harmonic oscillator of the disclosure, the harmonic oscillator sheet layer includes a substrate and at least one artificial microstructure attached on the substrate. The artificial microstructures are plane structures manufactured by conductive material and provided with geometric figures.

In the harmonic oscillator of the disclosure, the artificial microstructures are arranged at the edges of the substrate.

In the harmonic oscillator of the disclosure, a plurality of artificial microstructures is arranged in pairs. Each artificial microstructure pair is uniformly distributed by taking a circle center of a ring-shaped harmonic oscillator sheet layer surface as a circle center; and each artificial microstructure pair includes two identical artificial microstructures arranged in parallel.

In the harmonic oscillator of the disclosure, the artificial microstructure is a solid metal foil or a hollow metal foil with a plurality of holes.

The disclosure also relates to a microwave device for treating microwave; the microwave device is provided with at least one resonant cavity; and the harmonic oscillator is arranged in the resonant cavity. The harmonic oscillator includes a dielectric body and a support base positioned at the bottom of the dielectric body; the dielectric body includes a plurality of harmonic oscillator sheet layers with through holes and a connection part penetrated through the through holes of each harmonic oscillator sheet layer in turn and connected with the support base so as to fixedly connect the dielectric body and the supporting base integrally.

In the microwave device of the disclosure, the bottom surface of the resonant cavity is provided with a thread hole; the support base is provided with a through hole; the connection part is a bolt; and the bolt is penetrated through the harmonic oscillator sheet layers and the through hole of the support base in turn, then assembled and locked with the thread hole of the resonant cavity.

In the microwave device of the disclosure, the bottom surface of the resonant cavity is provided with a through hole; the support base is provided with a through hole; the connection part is a bolt and a nut; and the bolt is assembled and locked with the nut after penetrating through the harmonic oscillator sheet layers, the support base and the through hole of the bottom surface of the resonant cavity in turn.

In the microwave device of the disclosure, the bolt and the nut are fastened integrally in a manner of welding or hot pressing.

In the microwave device of the disclosure, the microwave device is a cavity filter or a duplexer.

The disclosure also relates to a communication device. The communication device is provided with the microwave device for treating the microwave.

In the communication device of the disclosure, the communication device is a microwave oven, a base station, radar, or an aircraft.

The implementation of the harmonic oscillator, the microwave device and the communication device of the disclosure has the following beneficial effect that the harmonic oscillator sheet layers and the support base are strung and fixed by the connection part, so that the microwave device and the communication device with the harmonic oscillator are good in structure stability, thus swinging of the harmonic oscillator sheet layers causes low loss.

Another purpose of the disclosure is to provide a harmonic oscillator capable of realizing miniaturization and not affecting a resonant frequency and other capability, and a cavity filter and an electromagnetic wave device thereof. The electromagnetic wave device of the disclosure may be also called as a communication device or a microwave device.

The technical solution used by the disclosure for solving the technical problem is to structure a harmonic oscillator. The harmonic oscillator includes at least one dielectric slab and at least one response unit attached on one surface of the at least one dielectric slab, wherein the response unit is a structure manufactured by conductive material and provided with geometric patterns.

In the harmonic oscillator of the disclosure, the response unit presents positive equivalent refractive index in an electromagnetic field corresponding to a working frequency of the harmonic oscillator.

In the harmonic oscillator of the disclosure, the dielectric constant and the magnetic conductivity of the response unit in the electromagnetic field corresponding to the working frequency of the harmonic oscillator are positive values.

In the harmonic oscillator of the disclosure, a plurality of response units is attached on the surface of the at least one dielectric slab and not electrically connected with each other.

In the harmonic oscillator of the disclosure, at least one response unit is arranged at the edge of the surface of the dielectric slab.

In the harmonic oscillator of the disclosure, the equivalent refractive indexes of different at least one response unit on each dielectric slab are increased along with the increase of the distance from the different at least one response unit to a center point on the surface of the dielectric slab.

In the harmonic oscillator of the disclosure, a size of different response units on each dielectric slab is increased along with the increase of the distance from the different response units to the center point on the surface of the dielectric slab.

In the harmonic oscillator of the disclosure, the harmonic oscillator includes a plurality of dielectric slabs stacked in turn; the at least one response unit is attached on the surface of at least one of the plurality of dielectric slabs.

In the harmonic oscillator of the disclosure, the at least one response unit is attached on one or more dielectric slabs located at both ends of the stacked harmonic oscillator.

In the harmonic oscillator of the disclosure, a working frequency of the harmonic oscillator is less than a resonant frequency of the response unit or greater than a plasma frequency of the response unit.

In the harmonic oscillator of the disclosure, a size of the response unit is less than a wavelength of an electromagnetic wave corresponding to a working frequency of the harmonic oscillator.

In the harmonic oscillator of the disclosure, a size of the response unit is less than 50% of a wavelength of an electromagnetic wave corresponding to a working frequency of the harmonic oscillator.

In the harmonic oscillator of the disclosure, a size of the response unit is less than 20% of a wavelength of an electromagnetic wave corresponding to a working frequency of the harmonic oscillator.

In the harmonic oscillator of the disclosure, a size of the response unit is less than 10% of a wavelength of an electromagnetic wave corresponding to a working frequency of the harmonic oscillator.

In the harmonic oscillator of the disclosure, the at least one dielectric slab is manufactured by material with a dielectric constant greater than 1 and a loss angle tangent value less than 0.1.

In the harmonic oscillator of the disclosure, the at least one dielectric slab is manufactured by material with a dielectric constant greater than 30 and a loss angle tangent value less than 0.01.

In the harmonic oscillator of the disclosure, the at least one dielectric slab is manufactured by microwave dielectric ceramics.

In the harmonic oscillator of the disclosure, the conductive material is metal material.

In the harmonic oscillator of the disclosure, the conductive material is gold, silver and copper; or the conductive material is an alloy containing gold, silver or copper.

In the harmonic oscillator of the disclosure, the conductive material is non-metallic material.

In the harmonic oscillator of the disclosure, the conductive material is indium tin oxide, aluminum doped zinc oxide or conductive graphite.

In the harmonic oscillator of the disclosure, the at least one response unit is anisotropic structures.

In the harmonic oscillator of the disclosure, a plurality of response units is arranged and distributed on the at least one dielectric slab in a manner of ring array or rectangular array.

In the harmonic oscillator of the disclosure, the response unit is net-shaped, and includes one metal sheet, and a plurality of holes is hollowed on the metal sheet.

In the harmonic oscillator of the disclosure, the at least one response unit is a fan-shaped metal sheet, and a plurality of fan-shaped metal sheets is arranged as a circumference by taking one point as a circle center.

In the harmonic oscillator of the disclosure, the at least one response unit presents square, two square response units are arranged with intervals side by side to form one response unit pair, and a plurality of response unit pairs is arranged as a circumference by taking one point as a circle center.

The disclosure also relates to a cavity filter. The cavity filter includes at least one resonant cavity and a harmonic oscillator positioned in the at least one resonant cavity; the harmonic oscillator includes at least one dielectric slab and at least one response unit attached on the surface of the at least one dielectric slab; and the at least one response unit is at least one structure manufactured by conductive material and provided with geometric patterns.

In the cavity filter of the disclosure, a first mode of the cavity filter is a TE mode; and the at least one response unit is arranged a plane parallel to an electrical field of the TE mode.

In the cavity filter of the disclosure, the at least one response unit of the harmonic oscillator is located on a partial region on the surface of the dielectric slab to which the response unit is attached; a component of the magnetic fields at various points in the partial region vertical to the surface of the dielectric slab is less than a predetermined value.

In the cavity filter of the disclosure, the partial region on the surface of the dielectric slab is located on the edge of the surface of the dielectric slab.

In the cavity filter of the disclosure, the cavity filter is a band-pass filter, a band stop filter, a high-pass filter, a low-pass filter or a multi-band filter.

The disclosure also relates to an electromagnetic wave device. The electromagnetic wave device includes a signal sending module, a signal receiving module and a cavity filter; an input end of the cavity filter is connected with the signal sending module, and an output end thereof is connected with the signal receiving module; the cavity filter includes a resonant cavity and a harmonic oscillator arranged in the resonant cavity; the harmonic oscillator includes at least one dielectric slab and at least one response unit attached on the surface of the at least one dielectric slab; and the at least one response unit is at least one structure manufactured by conductive material and provided with geometric patterns.

In the electromagnetic wave device of the disclosure, the electromagnetic wave device is a base station.

In the electromagnetic wave device of the disclosure, the base station includes a duplexer; the duplexer includes a signal sending band-pass filter and a signal receiving band-pass filter; and at least one of the signal sending band-pass filter and the signal receiving band-pass filter is a cavity filter.

In the electromagnetic wave device of the disclosure, the electromagnetic wave device is an aircraft, radar, or a satellite.

The adoption of the harmonic oscillator, and the cavity filter and the electromagnetic wave device thereof has the following beneficial effects: the harmonic oscillator of the disclosure has a positive equivalent refractive index, so that effectively improving the equivalent dielectric constant and the equivalent magnetic conductivity of the harmonic oscillator, thereby reducing the resonant frequency of the resonant cavity. Thus a size of the resonant cavity may be obviously reduced when the same resonant frequency is realized, so that the filtering devices such as the cavity filter or the duplexer and the like with the harmonic oscillator and the electromagnetic wave device thereof have the excellent miniaturization advantage.

Another purpose of the disclosure is to provide a harmonic oscillator, a resonant cavity, a filtering device and a microwave device with low loss and low resonant frequency on account of the defects of the prior art. The filtering device of the disclosure may be also called as a microwave device.

The technical solution used by the disclosure for solving the technical problem is to provide a harmonic oscillator. The harmonic oscillator includes two or more dielectric slabs stacked in turn; an artificial microstructure is arranged between at least two adjacent dielectric slabs of the dielectric slabs; the two adjacent dielectric slabs are connected through a bonding layer; the artificial microstructure is not covered by the bonding layer; and the artificial microstructure is a structure manufactured by conductive material and provided with geometric figure.

In the harmonic oscillator of the disclosure, the bonding layer covers the whole or partial region except the artificial microstructure between the two adjacent dielectric slabs.

In the harmonic oscillator of the disclosure, the artificial microstructure is arranged between each two adjacent dielectric slabs; each two adjacent dielectric slabs are bonded through the bonding layer; and the surface of the corresponding artificial microstructure is not covered by the bonding layer.

In the harmonic oscillator of the disclosure, the bonding layer includes two or more bonding points; and each bonding point is provided with a predetermined volume of bonding agent.

In the harmonic oscillator of the disclosure, the two or more bonding points are randomly or symmetrically distributed on a region between the two adjacent dielectric slabs.

In the harmonic oscillator of the disclosure, the bonding layer is a bonding ring composed of a layer of bonding agent; and the bonding agent is fully paved on a predetermined area between the two adjacent dielectric slabs.

In the harmonic oscillator of the disclosure, the bonding ring presents an irregular shape or a symmetrical shape.

In the harmonic oscillator of the disclosure, the dielectric slabs present ring-shaped; and the bonding ring presents a ring-shaped with a common center line of the dielectric slab.

In the harmonic oscillator of the disclosure, the artificial microstructure is randomly or regularly distributed on the surface of one of the two adjacent dielectric slabs.

In the harmonic oscillator of the disclosure, the artificial microstructure is distributed on the surface of one of the two adjacent dielectric slabs in a ring-shaped array or a rectangular array.

In the harmonic oscillator of the disclosure, the at least one dielectric slab presents ring-shaped, and the artificial microstructures are arranged in a ring-shaped array by taking the circle center of the surface of the at least one dielectric slab as a rotation center.

In the harmonic oscillator of the disclosure, the at least one dielectric slab present square, and the artificial microstructures are arranged in a rectangular array by taking a length side or a width side of the dielectric slab as a row direction and a line direction respectively.

In the harmonic oscillator of the disclosure, a thickness of the bonding layer is greater than or equal to a thickness of the artificial microstructure.

In the harmonic oscillator of the disclosure, a dielectric constant of bonding agents of the bonding layer is 1-5, and a loss angle tangent value is 0.0001-0.1.

In the harmonic oscillator of the disclosure, a dielectric constant of bonding agents of the bonding layer is 1-3.5, and a loss angle tangent value is 0.0001-0.05.

In the harmonic oscillator of the disclosure, a dielectric constant of bonding agents of the bonding layer is 2-3.5, and a loss angle tangent value is 0.0001-0.006.

In the harmonic oscillator of the disclosure, the artificial microstructure is arranged at the edge of the surface of one of the two adjacent dielectric slabs.

In the harmonic oscillator of the disclosure, the equivalent refractive index of the artificial microstructure is gradually increased along with the increase of the distance by facing outwards from a center of the attached dielectric slab of the artificial microstructure.

In the harmonic oscillator of the disclosure, a size of the artificial microstructure is gradually increased along with the increase of the distance by facing outwards from a center of the attached dielectric slab of the artificial microstructure.

In the harmonic oscillator of the disclosure, the two or more dielectric slabs are completely equal or incompletely equal in thickness.

The disclosure also provides a method for preparing the harmonic oscillator. The method includes the following steps:

a, processing at least one artificial microstructure on a surface of at least one dielectric slab, where each artificial microstructure is a structure manufactured by conductive material and provided with geometric figures;

b, putting bonding agents on surfaces of the dielectric slabs with the at least one artificial microstructures attached and obtaining at least one metamaterial slab, where the bonding agents are not coated on the at least one artificial microstructure;

c, stacking another dielectric slab on the metamaterial slab obtained in the step b, disposing the at least one artificial microstructure between the two dielectric slabs and bonding the two dielectric slabs by the bonding agents to form a bonding layer.

In the step a of the method of the disclosure, there are a plurality of dielectric slabs the number of which is a predetermined value; and the at least one artificial microstructure is processed on the surface of each dielectric slab.

In the step b of the method of the disclosure, the bonding agents are placed on the surface of each dielectric slab on which the at least one artificial microstructure is attached respectively; the bonding agents are not coated on the artificial microstructures; and a plurality of metamaterial slabs is obtained and is stacked in the same direction in turn.

In the step c of the method of the disclosure, another dielectric slab is stacked on the stacked at least one metamaterial slab obtained in the step b, so that the at least one artificial microstructure on the metamaterial slab at the outermost end is located between the dielectric slab of the metamaterial slab and the another dielectric slab; two adjacent dielectric slabs are connected through the bonding agents; and the bonding layers are formed by the bonding agents.

In the step b of the method of the disclosure, the at least one bonding agent is dispersed on the surfaces of the at least one dielectric slab through a glue dispersing machine; and each bonding point is formed respectively by the bonding agents of the points.

In the method of the invention, the bonding points are randomly or symmetrically distributed on the surfaces of the at least one dielectric slab.

In the step b of the method of the invention, the bonding agents are coated on the surfaces of the at least one dielectric slab in a shape of ring; and a bonding ring is formed by the ring-shaped bonding agents.

In the method of the disclosure, the bonding ring is of irregular shape or symmetrical ring shape.

In the method of the disclosure, the at least one dielectric slab is ring-shaped; and the bonding ring is shaped as a ring with a common center line of the dielectric slabs.

In the step c of the method of the disclosure, when the two dielectric slabs are bonded by the bonding agents, the pressure is applied to the two dielectric slabs or the two dielectric slabs are heated, so that the bonding agents are cured to form the bonding layer.

In the step b of the method of the disclosure, the predetermined volume amount of bonding agents are placed on the surfaces of the at least one dielectric slab.

In the method of the disclosure, the predetermined volume amount is less than the product of the area of the surface of the at least one dielectric slab with the artificial microstructure and a predetermined thickness of the bonding agents.

In the method of the disclosure, the predetermined thickness of the bonding layers is greater than or equal to the thickness of the artificial microstructures.

In the method of the disclosure, a dielectric constant of the bonding agents of the bonding layer is 1-5, and a loss angle tangent value thereof is 0.0001-0.1.

In the method of the disclosure, a dielectric constant of the bonding agents of the bonding layer is 1-3.5, and a loss angle tangent value thereof is 0.0001-0.05.

In the method of the disclosure, a dielectric constant of the bonding agents of the bonding layer is 2-3.5, and a loss angle tangent value thereof is 0.0001-0.006.

In the method of the disclosure, the two or more dielectric slabs are completely equal or incompletely equal in thickness.

In the step a of the method of the disclosure, the at least one artificial microstructures with the geometric figures are processed by plating conductive material layers on the surfaces of the dielectric slab and then etching the conductive material layers.

The disclosure also relates to the other method for preparing the harmonic oscillator. The method includes the following steps:

a, processing artificial microstructures on a surface of the at least one dielectric slab, where the at least one artificial microstructure is at least one structure manufactured by conductive material and provided with geometric figures;

b, placing bonding agents on the surface of the other dielectric slab;

c, bonding the dielectric slab obtained in the step a with the dielectric slab obtained in the step b, disposing the artificial microstructures between the two dielectric slabs, wherein the bonding agents are not coated on the artificial microstructures, and the two dielectric slabs are bonded by the bonding agents to form a bonding layer.

In the step a of the method of the disclosure, the at least one artificial microstructures with the geometric figures are processed by plating conductive material layers on the surfaces of the dielectric slab and then etching the conductive material layers.

In the step b of the method of the disclosure, the bonding agents are dispersed on the other surface through a glue dispersing machine.

In the step c of the method of the disclosure, when the two dielectric slabs are bonded by the bonding agents, the pressure is applied to the two dielectric slabs or the two dielectric slabs are heated, so that the bonding agents are cured to form the bonding layer.

The disclosure also relates to a method for preparing the harmonic oscillator according to claim 1. The method includes the following steps:

a, processing at least one artificial microstructure on a surface of at least one dielectric slab, where each artificial microstructure is a structure manufactured by conductive material and provided with geometric figures;

b, placing a bonding agent on the other surface of the dielectric slab, where the projection of the bonding agent on the surface with the artificial microstructure is staggered and not coincided with the artificial microstructures;

c, repeating the step a and the step b in turn to prepare a plurality of dielectric slabs with the artificial microstructures on one surface and the bonding agents on the other surface;

d, stacking the plurality of dielectric slabs obtained in the step c in the same direction in turn, where two adjacent dielectric slabs are bonded by means of the bonding agents; the artificial microstructures are located between two dielectric slabs; the bonding agents are not coated on the artificial microstructures, and the two adjacent dielectric slabs are bonded by the bonding agents to form a bonding layer.

In the step a of the method of the disclosure, the at least one artificial microstructure with the geometric figures are processed by plating a conductive material layer on the surface of the dielectric slab and then etching the conductive material layers.

In the step b of the method of the disclosure, the bonding agents are dispersed on the other surface through a glue dispersing machine.

In the step d of the method of the disclosure, when the two dielectric slabs are bonded by the bonding agents, the pressure is applied to the two dielectric slabs or the two dielectric slabs are heated, so that the bonding agents are cured to form the bonding layer.

In the step d of the method of the disclosure, a plurality of dielectric slabs obtained in the step c is stacked in the same direction in turn, so that the bonding agent is arranged on the external surface of one of the two dielectric slabs at the outermost end; the artificial microstructures are arranged on the external surface of the other dielectric slab; and a dielectric slab with the artificial microstructures and a dielectric slab with the bonding agents are bonded on the external surfaces of the two dielectric slabs at the outermost end respectively.

The disclosure also relates to a resonant cavity. The resonant cavity includes a cavity and a harmonic oscillator in the cavity; and the harmonic oscillator is the harmonic oscillator according to any one of the above items.

The disclosure also relates to a filtering device, including at least one resonant cavity, where the at least one resonant cavity is the above resonant cavity.

In the filtering device of the disclosure, the filtering device is a filter or a duplexer.

In the filtering device of the disclosure, the filtering device is a band-pass filter, a band-block filter, a high-pass filter, a low-pass filter or a multi-band filter.

The disclosure also relates to a microwave device, including a signal sending module, a signal receiving module and a filtering device; an input end of the filtering device is connected with the signal sending module, and an output end thereof is connected with the signal receiving module; and the filtering device is the above filtering device.

In the microwave device of the disclosure, the microwave device is a base station.

In the microwave device of the disclosure, the base station includes a duplexer; the duplexer includes a signal sending band-pass filter and a signal receiving band-pass filter; and at least one of the signal sending band-pass filter and the signal receiving band-pass filter is the above filtering device.

In the microwave device of the disclosure, the electromagnetic wave device is an aircraft, radar, or a satellite.

The implementation of the disclosure has the following beneficial effects that the bonding layers used in the disclosure are not coated on the harmonic oscillator of the surface of the artificial microstructure; loss of the harmonic oscillator is much lower than loss when the bonding layers are coated on the surface of the artificial microstructure, so that the Q value of the harmonic oscillator prepared by the disclosure is high; and loss of the harmonic oscillator, the filtering device and the microwave device with the resonant cavity is reduced obviously.

BRIEF DESCRIPTION OF DRAWINGS

The disclosure is further illustrated with reference to the drawings and the embodiments as follows. In the drawings.

DESCRIPTION OF EMBODIMENTS

Figure 1:
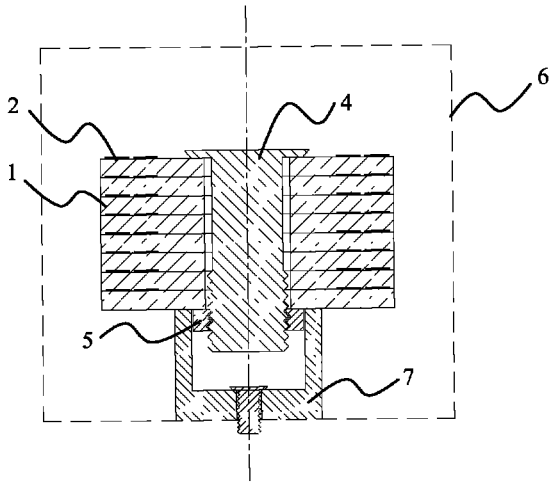
FIG. 1 is a schematic structural diagram of a microwave device according to a first embodiment of the disclosure.
Figure 2:
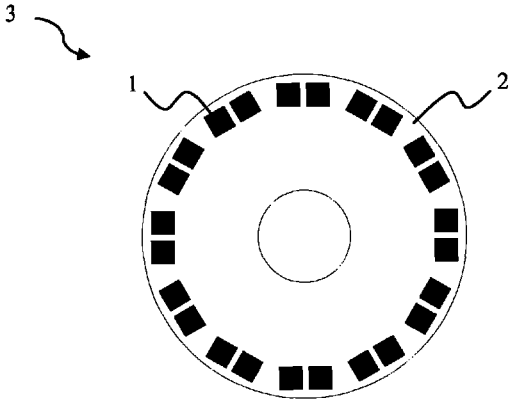
FIG. 2 is a top view of a first harmonic oscillator sheet layer.

The disclosure relates to a harmonic oscillator illustrated in FIG. 1 and FIG. 2 includes a plurality of harmonic oscillator sheet layers 3; a through hole is formed on the middle of each harmonic oscillator sheet layer 3, preferably the harmonic oscillator sheet layers 3 are shaped as rings with same shape, same or different height. The harmonic oscillator sheet layers 3 are stacked in turn to form a hollow cylinder.

The harmonic oscillator sheet layers 3 are manufactured by microwave dielectric ceramics which are used for manufacturing dielectric harmonic oscillators at present, such as known $BaTi_4O_9$, $Ba_2Ti_9O_{20}$, $MgTiO_3$-$CaTiO_3$, BaO-$Ln_2O_3$-$TiO_2$ series, $Bi_2O_3$-ZnO—$Nb_2O_5$ series and the like; certainly, the harmonic oscillator sheet layers 3 may be manufactured by other materials with relatively high dielectric constant and relatively small loss angle tangent, such as F4B material, FR-4 material and the like.

The disclosure preferably uses the harmonic oscillator sheet layers based on the metamaterial technology; the harmonic oscillator sheet layers include ring-shaped substrates 2 manufactured by the microwave dielectric ceramics or other materials; the substrates are also called as dielectric sheets hereinafter; the harmonic oscillator sheet layers also include at least one artificial microstructure 1 attached on the surface of the substrates 2, the artificial microstructure 1 is also called as a response unit hereinafter, and each artificial microstructure 1 is a structure composed of sheet or filamentous conductive material and provided with geometric patterns.

The sheet artificial microstructures 1 may be solid metal foils and also may be metal foils with a plurality of holes hollowed on the surfaces. The artificial microstructures 1 illustrated in FIG. 2 are solid square sheets or may be ring-shaped sheets, ring-shaped rings or other sheet structures. Every two identical square artificial microstructures in FIG. 2 are arranged side by side in parallel to form an artificial microstructure pair; each artificial microstructure pair is uniformly distributed as a circumference by taking a circle center of the surface of the ring-shaped harmonic oscillator sheet layer as a circle center. Obviously, the artificial microstructures in other shapes also may be arranged in this way. One or more holes are hollowed on the metal foils; and the holes are of ring shape, square shape or other random shape.

Figure 3:
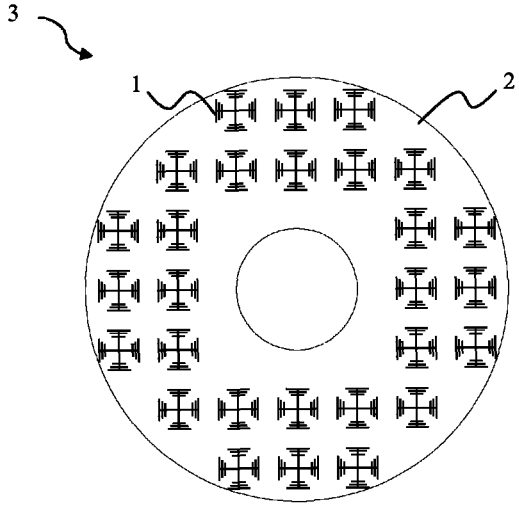
FIG. 3 is a top view of a second harmonic oscillator sheet layer.

The filamentous artificial microstructures 1 may be structures formed by helical lines, S-shaped meander lines, H-shaped lines, cross lines and two orthogonally bisectioning H-shaped lines, structures symmetrized by four same branches rotating around the same fixed point in 90 degrees and illustrated in FIG. 3 and other random structures.

A plurality of artificial microstructures 1 on the surfaces of the substrates 2 may be arranged in a shape of ring as FIG. 2, and also may be arranged in a rectangle array as FIG. 3 and randomly arranged according to the actual need. The conductive material includes various metals and metal alloys with good conductivity, such as silver, copper, silver alloy and copper alloy and the like; and the conductive material may be conductive non-metal material, such as indium tin oxide, aluminum-doped zinc oxide or conductive graphite and the like.

The electric field in the harmonic oscillator passes through or penetrates through the artificial microstructures when the harmonic oscillator works in the microwave resonant cavity due to the presence of the artificial microstructures 1, so that an equivalent capacitance is formed, thereby equivalently improving the dielectric constant of the harmonic oscillator, reducing the resonant frequency and beneficial to the miniaturization of the microwave resonant cavity.

Preferably, the at least one artificial microstructure 1 is located on the edge of the substrate, namely the distance from the at least one artificial microstructure to the center of the substrate is greater than half of the distance from the substrate edge to the center of the substrate. The reason is that the harmonic oscillator is closer to the part of the center, the electromagnetic field is stronger, the movement of the free electron in the at least one artificial microstructure 1 manufactured by the conductive material may cause energy loss, and the Q value of the harmonic oscillator is reduced. The artificial microstructure 1 is located on the edge of the substrate, so that the resonant frequency may be reduced and loss caused by the artificial microstructure 1 is reduced simultaneously.

In order to enhance the characteristic such as high dielectric constant and the like of the harmonic oscillator, the harmonic oscillator is cut into a plurality of sheet layers according to the need on a certain occasion; and the dielectric constant of the harmonic oscillator is increased by performing some treatments on the surfaces of the sheet layers, for example, a plurality of structures composed of copper foils or copper wires is attached. At the moment, as the harmonic oscillator may be a plurality of sheet layers, the usage effect is affected on one hand and loss may cause on the other hand if the harmonic oscillator is not fixed. Meanwhile, the harmonic oscillator and the support base are bonded by using organic adhesive, although the organic adhesive has a certain fastness, the temperature of the filter and the like is relatively high during working; and the softening of the organic adhesive may affect the firmness of bonding.

Consequently, another invention point of the disclosure lies in that the harmonic oscillator is also provided with the connection part which is penetrated through the through hole of each harmonic oscillator sheet layer in turn so as to string and fasten the harmonic oscillator sheet layers together. The connection part plays a role of fastening a plurality of harmonic oscillator sheet layers 3 together as a whole so as to prevent the harmonic oscillator sheet layers from arranging scatteredly and causing increase of loss.

As illustrated in FIG. 1, the connection part according to the embodiment includes a bolt 4 penetrated through the through holes and a nut 5 connected with the end of the bolt 4. The bolt 4 and the nut 5 are manufactured by the material with a dielectric constant less than 10 and a loss angle tangent value less than 0.1, and specifically, the material may be polyetherimide or Teflon material.

In order to prevent the loosening of the nut 5 from causing the loosening among the harmonic oscillator sheet layers 3; preferably, the nut 5 and the bolt 4 are fixedly connected together by welding or hot pressing. For example, when the bolt 4 and the nut 5 are manufactured by the Teflon material, the bolt 4 and the nut 5 are connected to be a non-removable entirety by heating and squeezing the bolt 4 and the nut 5.

Certainly, the connection part may be other structure, for example, a clamping pin, a spring clip with two ends propped against the upper and lower surfaces of the harmonic oscillator sheet layer stacked entirety and the like. The structures are not limited by the disclosure.

Further, the disclosure also discloses the microwave device with the harmonic oscillator, the microwave device is the cavity filter in the embodiment, as illustrated in FIG. 1, the microwave device is used for processing the microwave and provided with at least one resonant cavity 6; the inside of the resonant cavity 6 is provided with the harmonic oscillator; in general, the bottom of the harmonic oscillator is also provided with a support base 7 which is used for supporting the harmonic oscillator and positioning the harmonic oscillator in the center of the resonant cavity 6. In order to hold the part of the bolt 4 stretched out of the harmonic oscillator, a groove for holding rear end of the bolt 4 is formed on the upper surface of the support base 7.

On the one hand, the cavity filter with the harmonic oscillator is capable of effectively increasing the dielectric constant of the harmonic oscillator and reducing the resonant frequency of the resonant cavity based on the metamaterial technology, on the other hand, a plurality of harmonic oscillator sheet layers is fixedly connected by the connection part, so that the stability of the harmonic oscillator is enhanced and unnecessary loss caused by swinging of the harmonic oscillator sheet layer is reduced.

Certainly, the microwave device of the disclosure may be any component capable of performing a certain treatment on the microwave in the range of a certain frequency band by using the microwave resonant cavity and the harmonic oscillator, not only may be the filter, but also may be a duplexer or other components.

The disclosure also discloses a communication device with the microwave device. The device is provided with a plurality of functional modules correlated and interacted with each other to realize a relatively complex purpose, and the microwave device is used in one or more functional modules to treat the microwave. A plurality of communication devices exists, such as satellites, base stations, radar or aircrafts and the like. Due to the adoption of the microwave device in the communication device, an overall size and weight of the device can be reduced, loss is low and the purpose may be better played.

Figure 4:
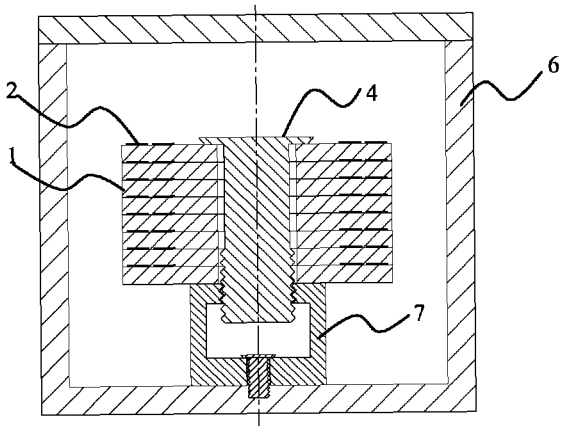
FIG. 4 is a schematic structural diagram of a microwave device according to a second embodiment of the disclosure.
Figure 5:
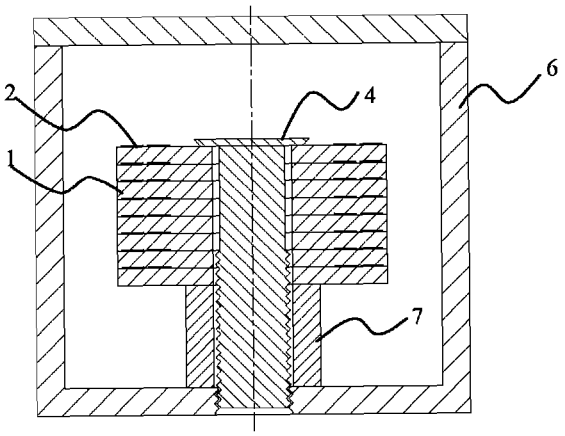
FIG. 5 is a schematic structural diagram of a microwave device according to a third embodiment of the disclosure.
Figure 6:
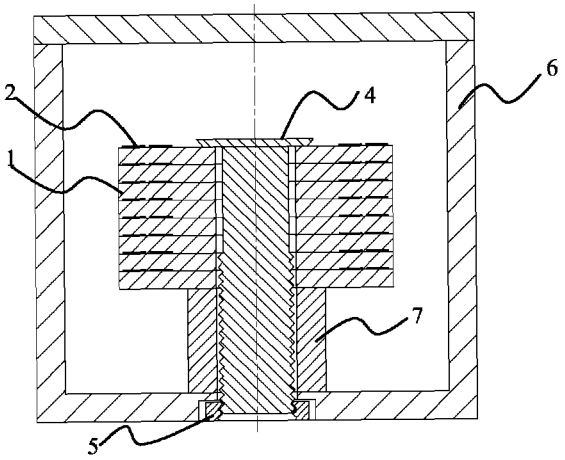
FIG. 6 is a schematic structural diagram of a microwave device according to a fourth embodiment of the disclosure.
Figure 7:
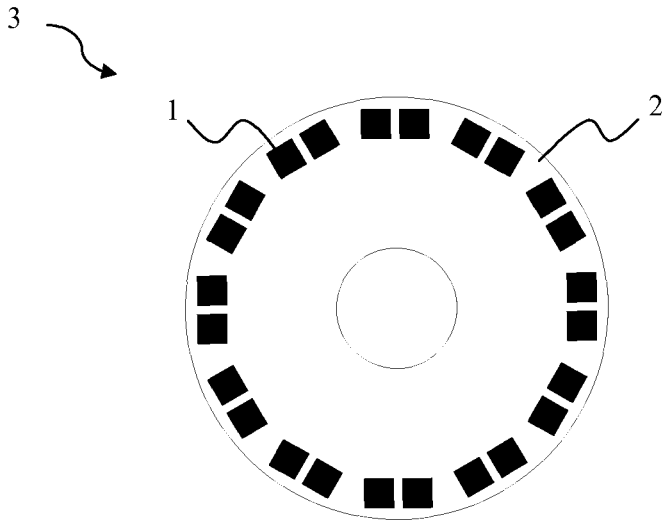
FIG. 7 is a top view of a third harmonic oscillator sheet layer.
Figure 8:
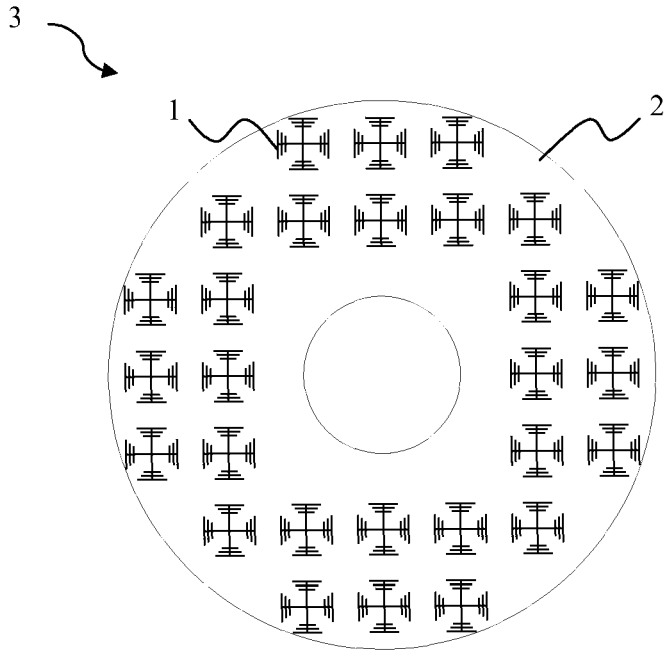
FIG. 8 is a top view of a fourth harmonic oscillator sheet layer.

In the other group of embodiments, the harmonic oscillator illustrated in FIG. 4, FIG. 5 and FIG. 6 includes a dielectric body and a support base 7 which is arranged at the bottom of the dielectric body. The dielectric body is composed of a plurality of harmonic oscillator sheet layers 3, as illustrated in FIG. 7 and FIG. 8, through holes are formed on the middle of each harmonic oscillator sheet layer 3, preferably, the harmonic oscillator sheet layers 3 are rings with same shape, same or different height and are stacked into hollow cylinders in turn.

The harmonic oscillator sheet layers 3 are manufactured by microwave dielectric ceramics which are used for manufacturing dielectric harmonic oscillators at present, such as known $BaTi_4O_9$, $Ba_2Ti_9O_{20}$, $MgTiO_3$-$CaTiO_3$, BaO-$Ln_2O_3$-$TiO_2$ series, $Bi_2O_3$-ZnO—$Nb_2O_5$ series and the like, certainly, the harmonic oscillator sheet layers 3 may be manufactured by other materials with relatively high dielectric constant and relatively small loss angle tangent, such as F4B material, FR-4 material and the like.

The disclosure preferably uses the harmonic oscillator sheet layers based on metamaterial technology, the harmonic oscillator sheet layers include ring-shaped substrates 2 which are manufactured by microwave dielectric ceramics or other materials; the harmonic oscillator sheet layers also include at least one artificial microstructure 1 attached on the surface of the substrates 2, and each artificial microstructure 1 is a structure composed of sheet or filamentous conductive material and provided with geometric patterns.

The sheet artificial microstructures 1 may be solid metal foils and also may be metal foils with a plurality of holes hollowed on the surfaces. The artificial microstructures 1 illustrated in FIG. 7 are solid square sheets or may be ring-shaped sheets, ring-shaped rings or other sheet structures. Every two identical square artificial microstructures in FIG. 5 are arranged side by side in parallel to form an artificial microstructure pair; each artificial microstructure pair is uniformly distributed as a circumference by taking the circle center of the surface of the ring-shaped harmonic oscillator sheet layer as a circle center. Obviously, the artificial microstructures in other shapes also may be arranged in this way. One or more holes are hollowed on the metal foils; and the holes are maybe of ring shape, square shape or other random shape.

The filamentous artificial microstructures 1 may be structures formed by helical lines, S-shaped meander lines, H-shaped lines, cross lines and two orthogonally bisectioning H-shaped lines, structures symmetrized by four same branches rotating around the same fixed point in 90 degrees and illustrated in FIG. 8 and other random structures.

A plurality of artificial microstructures 1 on the surfaces of the substrates 2 may be arranged in a shape of ring as FIG. 7 and also may be arranged in a rectangle array as FIG. 8 and randomly arranged according to the actual need. The conductive material includes various metals and metal alloys with good conductivity, such as silver, copper, silver alloy and copper alloy and the like; and the conductive material may be conductive non-metal material, such as indium tin oxide, aluminum-doped zinc oxide or conductive graphite and the like.

The electric field in the harmonic oscillator passes through or penetrates through the artificial microstructures when the harmonic oscillator works in the microwave resonant cavity due to the presence of the artificial microstructures 1, so that an equivalent capacitance is formed, thereby equivalently improving the dielectric constant of the harmonic oscillator, reducing the resonant frequency and beneficial to the miniaturization of the microwave resonant cavity.

Preferably, the at least one artificial microstructure 1 is located on the edge of the substrate, namely the distance from the at least one artificial microstructure to the center of the substrate is greater than half of the distance from the substrate edge to the center of the substrate. The reason is that the harmonic oscillator is closer to the part of the center, the electromagnetic field is stronger, the movement of the free electron in the at least one artificial microstructure 1 manufactured by the conductive material may cause energy loss, and the Q value of the harmonic oscillator is reduced. The artificial microstructure 1 is located at the edge of the substrate, so that the resonant frequency may be reduced and loss caused by the artificial microstructure 1 is reduced simultaneously.

The support base 7 is used for supporting the dielectric body and positioning the dielectric body in the center of the resonant cavity. In general, the bottom of the support base 7 is fixedly connected through bolts; and the top is bonded with the harmonic oscillator via organic adhesive. The support base 7 is manufactured by wave-transmitting material which is the material with a wave transmission rate greater than 90%, and the wave-transmitting material includes aluminium oxide, silicon dioxide, glass ceramic, silicon nitride, reinforced fibers and wave-transmitting composite material composed of basis material and the like. The disclosure preferably uses the aluminium oxide.

Another invention point of the disclosure lies in that the harmonic oscillator is also provided with the connection part which is penetrated through the through hole of each harmonic oscillator sheet layer 3 in turn and connected with the support base 7 together so as to string and fasten the harmonic oscillator sheet layers 3 and the support base 7 together. The connection part plays a role of fastening a plurality of harmonic oscillator sheet layers 3 and the support base 7 together as a whole so as to prevent the harmonic oscillator sheet layers and the support base from arranging scatteredly and causing increase of loss.

As illustrated in FIG. 4, the connection part according to the embodiment is a long-rod bolt 4. The bolt 4 is manufactured by the material with a dielectric constant less than 10 and a loss angle tangent value less than 0.1, and specifically, the material may be the polyetherimide or the Teflon material. A thread hole is formed on the upper surface of the support base 7, and the bolt 4 is penetrated through the through holes of each harmonic oscillator sheet layer, and assembled and locked with the thread hole on the support base 7.

In order to prevent the loosening of the bolt 4 from causing the loosening among the harmonic oscillator sheet layers 3 and the support base 7; preferably, the bolt 4 is fixedly connected together with the support base by welding or hot pressing.

Certainly, the connection part may be other structure, for example, a clamping pin, a spring clip with two ends propped against the upper surfaces of the dielectric body and the lower surface of the support base and the like. The structures are not limited by the disclosure.

Further, the disclosure also discloses the microwave device which is provided with the harmonic oscillator and used for processing the microwave. The microwave device according to the embodiment of the disclosure is the cavity filter.

In the second embodiment illustrated in FIG. 4, the microwave device includes at least one resonant cavity 6, the inside of the resonant cavity 6 is provided with the harmonic oscillator, and the harmonic oscillator includes a dielectric body and a support base 7. The support base 7 is used for supporting the dielectric body and positioning the dielectric body in the center of the resonant cavity 6. The connection part is a bolt 4, a thread hole is formed on the surface of the support base 7, and the bolt 4 is penetrated through the harmonic oscillator sheet layer 3, and assembled and fixed with the thread hole.

In the third embodiment illustrated in FIG. 5, the thread hole is formed on the bottom surface of the resonant cavity 6, the through hole is formed on the support base 7, the connection part is the bolt 4, the bolt 4 is assembled and locked with the thread hole of the resonant cavity 6 after penetrating through each harmonic oscillator sheet layer 3 and the through hole of the support base 7 in turn.

In the fourth embodiment illustrated in FIG. 6, the through hole is formed on the bottom surface of the resonant cavity 6, the through hole is formed on the support base 7, the connection part includes the bolt 4 and the nut 5; the bolt 4 is assembled and locked with the nut 5 after penetrating through each harmonic oscillator sheet layer 3 and the through holes of the support base 7 and the bottom surface of the resonant cavity 6 in turn. In order to prevent the bolt 4 from loosening, the bolt 4 and the nut 5 may be fastened as a whole in a manner of welding or hot pressing.

On the one hand, the cavity filter with the harmonic oscillator is capable of effectively increasing the dielectric constant of the harmonic oscillator and reducing the resonant frequency of the resonant cavity based on the metamaterial technology, on the other hand, a plurality of harmonic oscillator sheet layers, the support base and the resonant cavity are fixedly connected by the connection part, so that stability of the harmonic oscillator is enhanced and unnecessary loss caused by swinging of the harmonic oscillator sheet layer is reduced.

Certainly, the microwave device of the disclosure may be any component capable of performing a certain treatment on the microwave in the range of a certain frequency band by using the microwave resonant cavity and the harmonic oscillator, not only may be the filter, but also may be a duplexer or other components.

The disclosure also discloses the communication device with the microwave device. The device is provided with a plurality of functional modules correlated and interacted with each other to realize a relatively complex purpose; and the microwave device is used in one or more functional modules to treat the microwave. A plurality of communication devices exists, such as satellites, base stations, radar or aircrafts and the like. Due to the adoption of the microwave device in the communication device, an overall size and weight of the device can be reduced, loss is low and the purpose may be better played.

Figure 9:
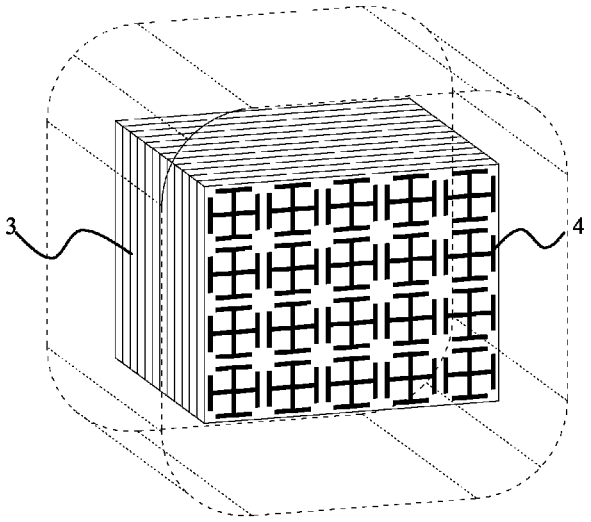
FIG. 9 is a schematic structural diagram of a harmonic oscillator according to the first embodiment of the disclosure.

The disclosure relates to a harmonic oscillator, illustrated in FIG. 9, includes a dielectric slab 3 and a response unit 4 attached on the surface of the dielectric slab 3. Each harmonic oscillator includes a dielectric slab 3 and may includes a plurality of dielectric slabs 3, illustrated in FIG. 9, a plurality of dielectric slabs 3 is stacked together and connected integrally in manners of bonding and connecting via a fastening part and the like. The dielectric slabs 3 of the disclosure is especially used in the cavity filter and taken as the materials of the dielectric harmonic oscillator, the materials has the characteristics of high dielectric constant, low loss angle tangent value and the like, and under a working frequency of the harmonic oscillator, the dielectric constant is higher than 30 in general while the loss angle tangent value is less than 0.01. The common materials meeting the requirements may be microwave dielectric ceramics, such as $BaTi_4O_9$, $Ba_2Ti_9O_{20}$, $MgTiO_3$-$CaTiO_3$, BaO-$Ln_2O_3$-$TiO_2$ series, $Bi_2O_3$-ZnO—$Nb_2O_5$ series and the like. Certainly, other materials besides the ceramics meeting the requirements also may be taken as the dielectric slabs of the disclosure as long as the dielectric constant of the material is greater than 1 while the loss angle tangent value is less than 0.1, for example, polytetrafluoroethylene, epoxy resin and the like.

The dielectric slabs 3 may be of any shapes, such as square column, square slice, ring, cylinder, column, irregular shape and the like. The shapes of the dielectric slabs 3 are different according to the difference of the shapes of the used resonant cavity, as long as the shapes of the dielectric harmonic oscillator in the prior art, the shapes may be used as the shapes of the dielectric slabs 3 of the disclosure. Preferably, the dielectric slabs are of regular symmetrical structure, such as square column or cylinder; and the most common shape is cylinder.

The working frequency of the harmonic oscillator in the disclosure is the working frequency needed by the corresponding cavity filter or the duplexer in the resonant cavity of the cavity filter or the duplexer, such as the resonant frequency of the electromagnetic field corresponding to the first mode (the main mode); and the resonant frequency is equivalent to the resonant frequency of the dielectric slabs 3 of the harmonic oscillator usually.

The response unit 4 is attached on the surface of at least one dielectric slab 3. Specifically, one or more response units 4 are attached on the surface of any dielectric slab 3. When a plurality of response units 4 is attached, the at least one response unit is mutually independent and not electrically connected with each other to be response monomers. Each response unit 4 is a structure manufactured by the conductive material and provided with geometric patterns.

The conductive material of the disclosure may be metals or alloys of the metals, such as silver, copper or alloys including one or two of gold, silver and copper and the like, the conductive material also may be conductive nonmetals, such as conductive graphite, aluminum-doped zinc oxide, indium tin oxide and the like.

In order to enable the at least one response unit 4 to have independent electromagnetic responses in the electromagnetic field, a size may be in the range of sub-wavelength, namely the size is less than the wavelength of the electromagnetic wave corresponding to the working frequency of the harmonic oscillator, the size is less than 50% of the wavelength in general, the size is smaller the better, preferably less than 20% and most preferably less than 10%. According to the disclosure, the size of the at least one response unit 4 is the length of a longest line segment in any line segments connected between two points on the curve forming the external profile of the at least one response unit 4.

The at least one response unit 4 may be randomly distributed on the surface of the dielectric slab 3 and preferably distributed on the surface of the dielectric slab in a certain rule, such as rectangular array arrangment, ring-shaped array arrangment and the like. When the dielectric slab 3 is ring-shaped, the at least one response unit 4 is preferably arranged in ring-shaped array so as to realize the symmetry of the structure.

The first invention point of the disclosure lies in that the at least one response unit 4 meeting the size requirements also has to present positive equivalent refractive index in the electromagnetic field corresponding to the working frequency of the harmonic oscillator. In other words, the response unit 4 presents a positive equivalent refractive index in the electromagnetic field with a frequency which is equivalent to the resonant frequency of the dielectric material corresponding to the dielectric slab 3.

Figure 10:
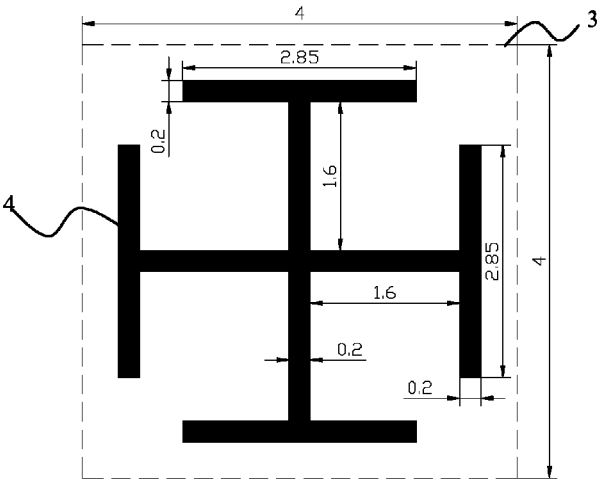
FIG. 10 is a schematic structural diagram of a response unit.
Figure 11:
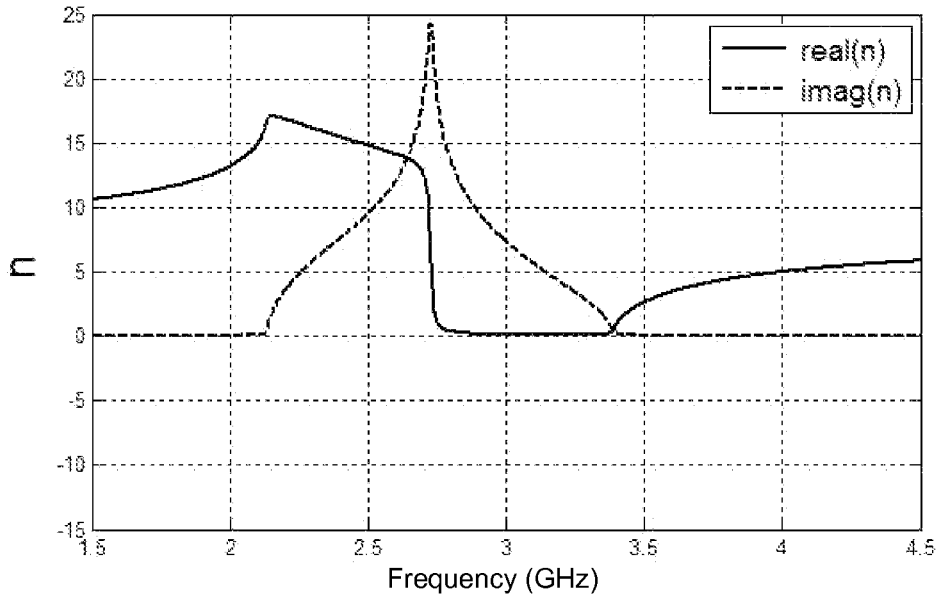
FIG. 11 is an equivalent refractive index-frequency relation curve of the response unit illustrated in the FIG. 10.

The equivalent refractive index of each response unit 4 is a curve related to the frequency, in any given response unit, illustrated in FIG. 10, the unit of marks is millimeter (mm), the conductive material is copper foil. A relation curve between the equivalent refractive index and the frequency, illustrated in FIG. 11, is obtained by limiting the dielectric constant and the loss angle tangent value of the attached dielectric slab, taking a certain thickness, for example 2 mm, and simulating the response unit and the dielectric slab in the simulation software. The FIG. 11 shows that the equivalent refractive index of the response unit in the entire frequency band range is a positive value. Consequently, the response unit may be used in the harmonic oscillator of the disclosure. The more specific algorithm of the equivalent refractive index of the response unit may refer to the paper Description and explanation of electromagnetic behaviors in artificial metamaterials based on effective dielectric theory which is jointly together co-write by Ruopeng Liu, Tie Jun Cui, Da Huang, Bo Zhao and David R. Smith and published in 2007.

Figure 12:
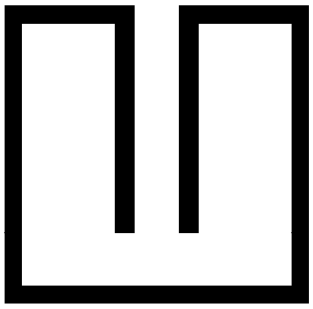
FIG. 12 is a schematic structural diagram of the other response unit.
Figure 13:
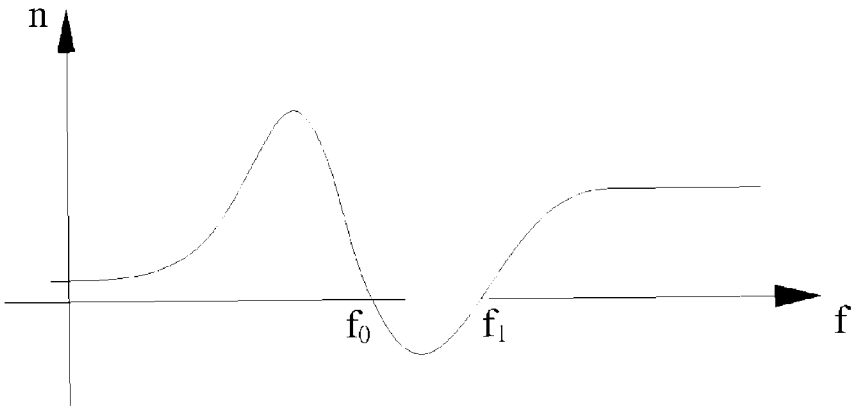
FIG. 13 is an equivalent refractive index-frequency relation curve of the response unit illustrated in the FIG. 12.

The FIG. 12 shows that the other response unit is a split resonant ring structure which is a typical structure for realizing negative permeability and negative refraction. The response curve between the equivalent refractive index and the frequency of the split resonant ring is illustrated in FIG. 13. In the described embodiment, a frequency point at 0 is a resonant frequency f0 when the equivalent refractive index is converted from a positive value to a negative value, and the frequency point at 0 is a plasma frequency f1 when the equivalent refractive index is converted from a negative value to a positive value. In order to enable the equivalent refractive index to be positive, the working frequency of the harmonic oscillator is demanded to be less than the resonant frequency f0 or greater than the plasma frequency f1.

Consequently, on account of the response unit with the equivalent refractive index which is negative value in the whole frequency range, in order to enable the at least one response unit to present positive equivalent refractive index in the electromagnetic field corresponding to the working frequency of the harmonic oscillator, the working frequency of the harmonic oscillator may be less than the resonant frequency of the response unit or higher than the plasma frequency of the response unit.

The curve of the equivalent refractive index of the response unit with respect to the frequency has a plurality of resonant frequencies and plasma frequencies, the working frequency of the harmonic oscillator is less than the minimum resonant frequency or greater than the maximum plasma frequency, or is in the frequency range between the former plasma frequency and a high-order resonant frequency after the former plasma frequency.

The positive equivalent refractive index means that the dielectric constant and the magnetic conductivity are positive values. As long as one value of the dielectric constant and the magnetic conductivity is a negative value, the equivalent refractive index is negative. The at least one response unit of the positive equivalent refractive index acts on the harmonic oscillator, namely increasing the average dielectric constant of the harmonic oscillator. If the known harmonic oscillator is greater, the resonant frequency of the resonant cavity used for the harmonic oscillator is smaller and the size of the cavity when realizing the same resonant frequency is smaller, so that further miniaturization is realized.

Certainly, the at least one response unit 4 in the harmonic oscillator of the disclosure is not limited to be of a shape illustrated in FIG. 10 and may be of any shapes, such as solid sheet shape, hollow ring or net shape, snow shape, crotch shape, polygon shape, ring shape or other any irregular shapes. Preferably, the at least one response unit 4 is provided with a rotary symmetry center, so that the at least one response unit 4 is coincided with the primary response unit after rotating in 90 degrees randomly around the rotary symmetry center, and the at least one response unit 4 also may be ring-shaped, square, cross and the like.

Figure 14:
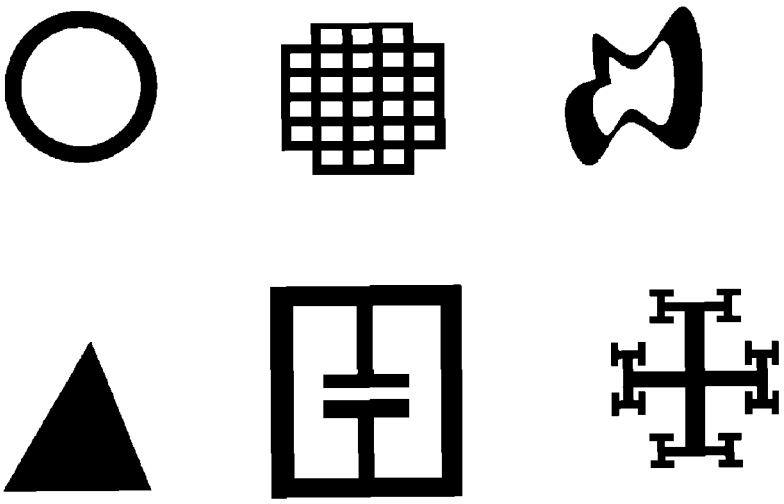
FIG. 14 is a possible structure shape of the response unit of the harmonic oscillator of the disclosure.

Possible several plane shapes of the at least one response unit 4 is illustrated in FIG. 14, the first response unit is ring-shaped; the second response unit is net-shaped and formed by hollowing a plurality of holes on a metal sheet; the holes may be of rectangular shape in the drawing and also may be of ring shape or other irregular shapes; the holes may be arranged in the rule illustrated in the drawing and also may be randomly arranged; the response unit in the shape may reduce loss; the third response unit is shaped as a ring composed of any irregular curves; the fourth response unit is a triangle metal sheet; a fifth response unit is an ELC structure and may be used for realizing negative magnetic conductivity; the sixth response unit is shaped as an I-shaped deformation; two large H-shaped structures are vertically orthogonal; a small I-shaped shape is connected with each tail end; obviously, the tail end of each small I-shaped shape is continuously connected with a smaller I-shaped shape. In addition, the at least one response unit also may be fan-shaped metal sheet which is enclosed by two concentric arcs and two straight lines connected with two ends of two arcs. A plurality of fan-shaped metal sheets is arranged as a circumference by taking one point as a circle center. The embodiments of other response units are not repeatedly illustrated in the disclosure.

Figure 16:
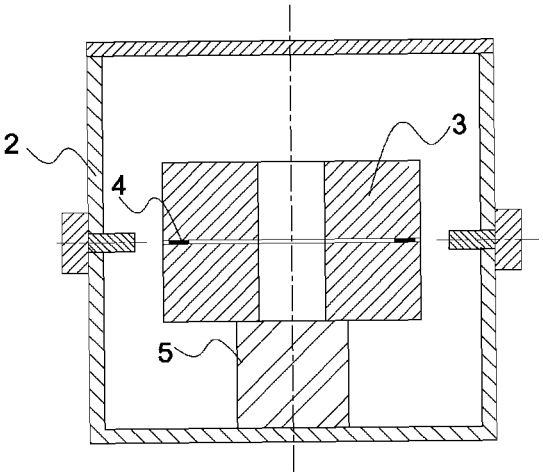
FIG. 16 is a schematic structural diagram of a resonant cavity of the harmonic oscillator illustrated in the FIG. 15.

Consequently, as illustrated in FIG. 16, the disclosure also discloses a cavity filter. The cavity filter includes at least one resonant cavity 2 and a harmonic oscillator which is arranged in the at least one harmonic oscillator 2. The cavity filter may be a band-pass filter, a band-stop filter, a high-pass filter, a low-pass filter or a multi-band filter. In order to simplify the schematic as follows, only one resonant cavity and the harmonic oscillator in the resonant cavity are drawn. Those skilled in the art very easily think that the cavity filter may have four resonant cavities, six resonant cavities, eight resonant cavities or more resonant cavities. The harmonic oscillator of the disclosure is placed in one resonant cavity; and the conventional dielectric harmonic oscillators or metal harmonic oscillators are arranged in other cavities. The harmonic oscillator of the disclosure may be arranged in several resonant cavities or all the resonant cavities.

The following specific experimental data is combined for illustrating that the resonant frequency may be effectively reduced by using the harmonic oscillator of the disclosure.

Figure 15:
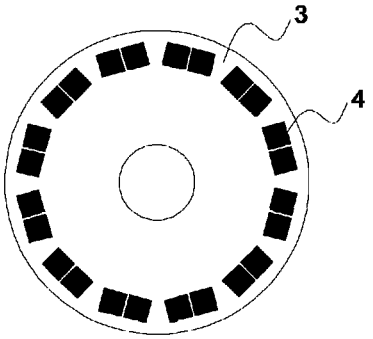
FIG. 15 is a schematic structural diagram of the harmonic oscillator according to the second embodiment.

The at least one response unit 4 is arranged on a dielectric slab 3 in an ring-shaped array illustrated in FIG. 15, where the at least one response unit is square; two square response units are arranged with intervals side by side to form a response unit pair; and a plurality of response unit pairs is arranged as a circumference by taking one point as a circle center. Each response unit 4 includes two square sheets which are arranged side by side; a total of 12 such response units 4 are arranged with equal spaces as a circumference having a semidiameter of 14 mm; the dielectric slab is manufactured by dielectric ceramic and shaped as ring with an inner diameter of 8 mm, an outer diameter of 24 mm and a thickness of 5 mm. The response unit is arranged between two same dielectric slabs 3 to form the harmonic oscillator according to one embodiment of the disclosure; the harmonic oscillator is located in the center of the resonant cavity; as illustrated in FIG. 16, the cavity of the resonant cavity is cylindrical; and the silver is plated on the inner wall of the cavity. The support base 5 may be arranged at the bottom of the harmonic oscillator; and a tuning scale is arranged on the top thereof.

The cavity filter is simulated by using simulation software to detect that the first mode of the filter is a TE mode; the resonant frequency of the mode (the resonant frequency of the cavity filter) is 2.265 GHz, and the Q value thereof is 10498. Meanwhile, the at least one response unit 4 is not arranged in the cavity filter, other conditions are not changed; in other words, after the conventional dielectric cavity filter is simulated, the resonant frequency of the cavity filter is 2.385 GHz and the Q value thereof is 10990. Through the harmonic oscillator of the disclosure, the frequency may be directly reduced to be 120 MHz while the Q alue is less affect. Consequently, the resonant frequency of the cavity filter may be effectively reduced by using the harmonic oscillator of the disclosure. The size of the resonant cavity may be smaller in a condition that the same resonant frequency is realized.

Figure 17:
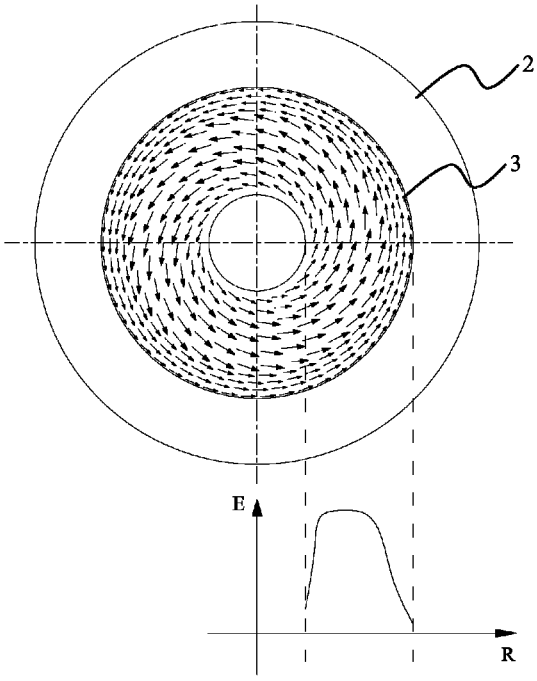
FIG. 17 is an electric field distribution diagram of a TM mode.

In the TE mode, as illustrated in FIG. 17, the direction and the size of the arrow show the direction and the size of the electric field. The FIG. 17 shows that the electric field horizontally surrounds around the center axis of the harmonic oscillator (the direction of the center axis of the harmonic oscillator is the vertical direction). Consequently, the at least one response unit is preferably arranged on the plane surrounded by the electric lines parallel to the TE mode, so that when the equivalent dielectric constant is maximized, the resonant frequency of the cavity filter is maximumly reduced. In the magnetic field of the TE mode illustrated in FIG. 18, the arrow presents the direction of the magnetic field. The magnetic field lines surround outwards from the center axis of the harmonic oscillator.

Consequently, in the disclosure, the at least one response unit is preferably arranged on a partial region of the surface of the attached dielectric slab parallel to the electric field in TE mode, and the component of the magnetic field at points of the partial region vertical to the surface of the dielectric slab is less than the predetermined value. In other words, the magnetic field is penetrated through the surface of the dielectric slab with the response unit, so that each point on the surface of the dielectric slab is provided with a corresponding special magnetic field strength; the components of each magnetic field in the direction vertical to the surface of the dielectric slab are different from each other, a maximum value is generated among the components, the predetermined value is a value less than 50% of the maximum value; and the predetermined value is the smaller the better. The set of the points corresponding to all the components less than the predetermined value forms the partial region of the surface. The at least one response unit is located in the region and is capable of effectively reducing the resonant frequency and preventing from generating great loss sacrifice and causing too small Q value.

Figure 18:
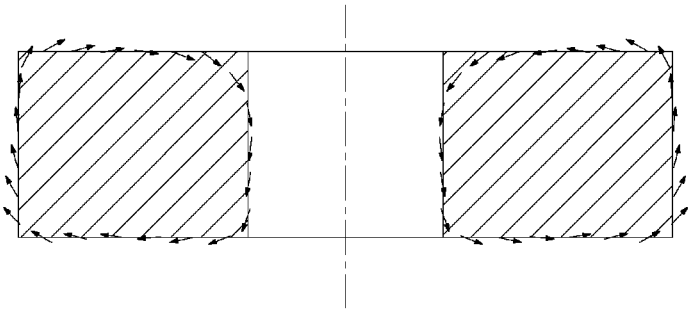
FIG. 18 is a magnetic field distribution diagram of the TM mode.

The FIG. 18 shows that the partial region is substantially arranged at the edge of the surface of the dielectric slab 3, the edge is the region range between the surface profile of the dielectric slab 3 and the curve of the profile shrunk by 50% by taking the center point of the surface of the dielectric slab as a shrinking center. The FIG. 18 also shows that the at least one response unit 4 is most preferably arranged on the surface region between the surface profile of the dielectric slab and the curve of the profile shrunk by 30% by taking the center point of the surface of the dielectric slab as a shrinking center.

By referring to the harmonic oscillator and the cavity filter illustrated in FIG. 15 and FIG. 16, when other conditions are not changed, the response unit 4 on the dielectric slab 3 is arranged with equal intervals as a circumference with a semidiameter of 7 mm to detect that the resonant frequency of the cavity filter in the novel embodiment is 2.194 GHz and the Q value thereof is 7942. Meanwhile, the known resonant frequency in the embodiment illustrated in FIG. 16 is 2.265 GHz, and the Q value thereof is 10498. Thus, the Q value may be effectively increased by arranging the response unit on the edge of the surface of the dielectric slab with pertinence.

On account of the response units 4 with similar geometric shapes, the equivalent refractive index is in direct proportion to the size; when the size is larger, the equivalent refractive index is greater. Consequently, when the shapes of the at least one response unit is similar or approximate in geometry, the size of the response units is increased or not reduced at least along with the increase of the distance from the response unit 4 to the center point of the surface of the dielectric slab 3.

Figure 19:
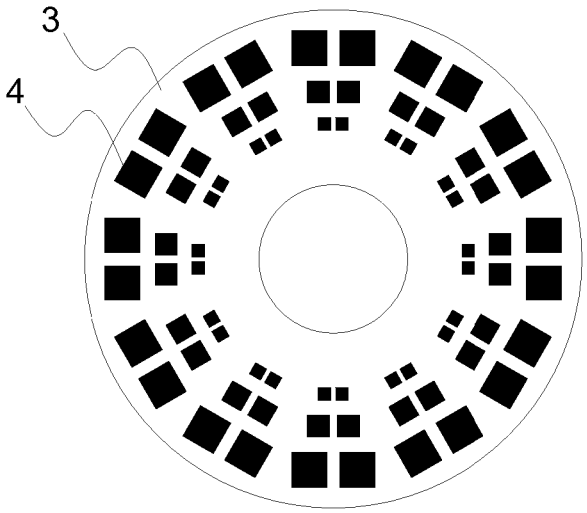
FIG. 19 is a schematic structural diagram of the harmonic oscillator according to the third embodiment.

For example, in the harmonic oscillator and the cavity filter illustrated in FIG. 15 and FIG. 16, two circles of response units with size gradually reduced are arranged in the response unit distributed as the circumference when other conditions are not changed. As illustrated in FIG. 19, the resonant frequency of the filter detected after simulating is 2.183 GHz, and the Q value thereof is 8278.

Figure 20:
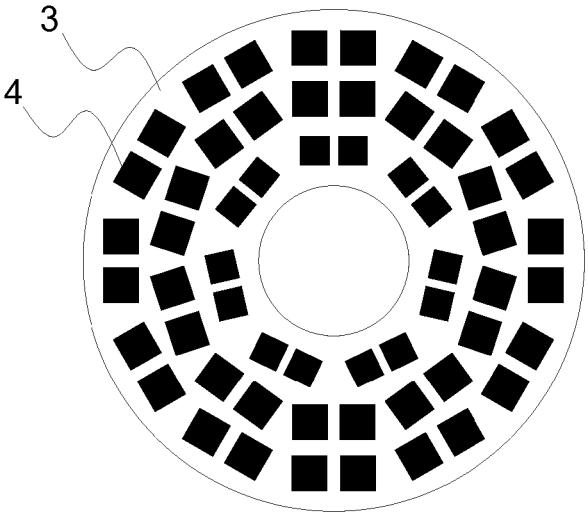
FIG. 20 is a schematic structural diagram of the harmonic oscillator according to the fourth embodiment.

The inner two circles of response units are arranged in turn as FIG. 20, the detected resonant frequency is 2.122 GHz and the Q value is reduced to be 3417. The contrast shows that when the large response unit is used, the frequency is more obviously reduced with little difference while the Q value is greatly reduced. Consequently, the distribution manner in which the size is smaller when the response unit is closer to the center is preferably used.

In addition, in the disclosure, the at least one response unit 4 is anisotropic structure preferably. The aeolotropism in the disclosure is opposite to isotropy. The isotropy is characterized in that a stereochemical structure has three symmetry planes; and every two three symmetry planes are mutually vertical to each other. The stereochemical structure is symmetrical around any one plane of symmetry; meanwhile, the stereochemical structure is divided into 8 same parts by three symmetry planes and coincided with one adjacent part after rotating in 90 degrees around the bondedary line of two symmetry planes. The structure not conformed to the requirement is the anisotropic structure. For example, the structure similar to the plane with thin thickness is the anisotropic structure necessarily. As electric field horizontally surrounds, the at least one response unit 4 is a flat anisotropic structure preferably.

The disclosure also relates to an electromagnetic wave device with the cavity filter. The electromagnetic wave device may be various devices with need of the cavity filter, such as aircrafts, base stations, radar, satellites and the like. The electromagnetic wave devices are capable of receiving and sending signal and filtering after receiving or before sending so as to enable the received or sent signal to meet the requirements. Consequently, the electromagnetic wave device at least also includes a signal sending module connected with the input end of the cavity filter and a signal receiving module connected with the output end of the cavity filter.

Figure 21:
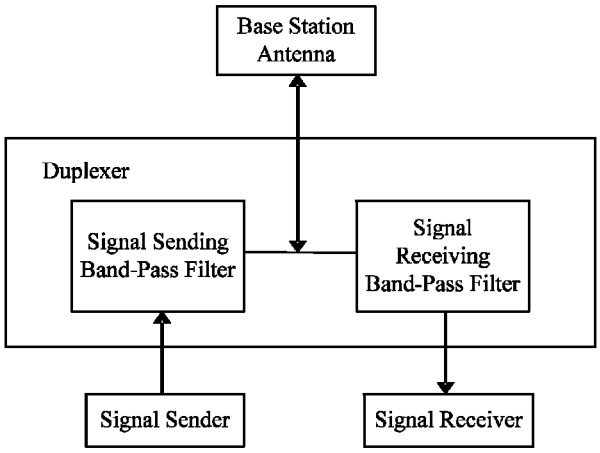
FIG. 21 is a schematic structural diagram when the electromagnetic wave device of the disclosure is a base station.

For example, as illustrated in FIG. 21, the electromagnetic wave device is the base station. The base station includes a duplexer taken as the filtering device. The duplexer includes a signal sending band-pass filter and a signal receiving band-pass filter. The input end of the signal sending band-pass filter is connected with a signal sender and the output end thereof is connected with the base station antenna; the input end of the signal receiving band-pass filter is connected with the base station antenna, and the output end thereof is connected with the signal receiver.

On account of the signal sending band-pass filter, the signal sending module is the signal sender, and the signal receiving module is the base station antenna. On account of the signal receiving band-pass filter, the signal sending module is the base station antenna; and the signal receiving module is the signal receiver. At least one of the signal sending band-pass filter and the signal receiving band-pass filter is the cavity filter with the harmonic oscillator of the disclosure. By using the cavity filter, the size of the filter may be greatly reduced, thereby being good for the miniaturization of the base station.

The disclosure also relates to a harmonic oscillator, a method for preparing the harmonic oscillator, a resonant cavity, a filtering device and a microwave device.

Figure 22:
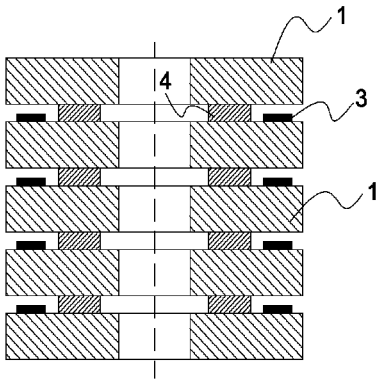
FIG. 22 is a front view semi-sectional diagram of a harmonic oscillator according to another embodiment of the disclosure.
Figure 27:
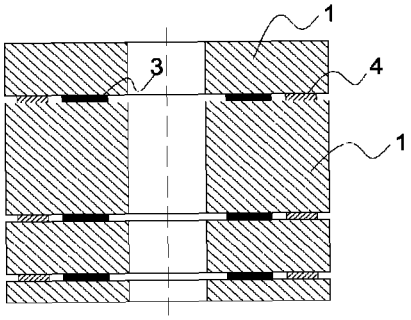
FIG. 27 is a front view semi-sectional diagram of a harmonic oscillator according to another embodiment of the disclosure.

As illustrated in FIG. 22, the harmonic oscillator includes two or more dielectric slabs 1 stacked in turn. The dielectric slabs 1 may be sheets in any shape or column with a certain thickness, such as rings, cylinders, square columns, rectangular plates and the like. In the disclosure, the harmonic oscillator is a cylindrical structure in general. Consequently, two or more dielectric slabs 1 forming the harmonic oscillator are preferably shaped as rings with through holes illustrated in FIG. 22 in the middle, so that the tuning rod is inserted into the through hole to perform tuning for the resonant frequency of the harmonic oscillator. Preferably, each dielectric slab 1 is provided with same cross section and size, so that the dielectric slabs 1 are stacked to form a column with constant cross section, in particular cylinder. The thickness of different dielectric slabs 1 may be equal illustrated in FIG. 22 and also may be incompletely equal as illustrated in FIG. 27.

The dielectric slabs 1 may be manufactured by any material with a dielectric constant which is greater than a dielectric constant of the air (the dielectric constant of the air is 1 substantially) and a loss angle tangent value less than 0.1. As the dielectric constant is greater, the size of the resonant cavity used by the harmonic oscillator is smaller when realizing the same resonant frequency, as the loss angle tangent value is smaller, the Q value of the harmonic oscillator is greater, preferably, the dielectric constant is relatively greater while the loss angle tangent value is smaller, for example, the dielectric constant is greater than 10 and the loss angle tangent value is less than 0.01, more preferably, the dielectric constant is greater than 30 and the loss angle tangent value is less than 0.001. The common material meeting the index requirement is microwave dielectric ceramic. A plurality of microwave dielectric ceramics such as $BaTi_4O_9$, $Ba_2Ti_9O_2$, $MgTiO_3$-$CaTiO_3$, BaO-$Ln_2O_3$-$TiO_2$ or $Bi_2O_3$-ZnO—$Nb_2O_5$ and the like may be used in the harmonic oscillator of the disclosure and taken as the material of the dielectric slabs 1.

The artificial microstructure 3 is arranged on the surface of at least one dielectric slab 1. As illustrated from FIG. 23 to FIG. 26, the artificial microstructure 3 is the structure manufactured by the conductive material and provided with geometric figure. The conductive material may be metal, such as gold, silver, copper or an alloy containing gold, silver or copper. The conductive material also may be other nonmetal materials which are provided with good conductivity and taken as good conductors, such as indium tin oxide, aluminum doped zinc oxide or conductive graphite and the like.

The geometrical shape of the artificial microstructure 3 is not limited in the disclosure. The shape may be square sheet shape illustrated in FIG. 23, snowflake shape illustrated in FIG. 24 and fan shape illustrated in FIG. 25, also may be an artificial microstructure pair composed of every two artificial microstructures in a group illustrated in FIG. 26 and also may be random shapes such as ring-shaped sheet shape, ring shape, triangle shape, split resonant ring and the like.

A plurality of artificial microstructures 3 is randomly distributed on the dielectric slab 1 and distributed on the surface of the dielectric slab 1 in a certain rule preferably. For example, the artificial microstructures 3 are arranged in ring-shaped array illustrated in any one of FIG. 23-FIG. 26, namely one artificial microstructure 3 is arranged in uniform circumference in equal parts by taking the center of the surface of the attached ring-shaped dielectric slab 1 as the rotating center. The artificial microstructure 3 in ring-shaped array may be only enclosed as a circle illustrated in FIG. 24-FIG. 26 and also may be enclosed as two circles or more circles illustrated in FIG. 23. Certainly, the artificial microstructure 3 of the disclosure also may be arranged according to the rectangular array. In the resonant cavity, the artificial microstructure is preferably arranged at the edge of the surface of the dielectric slab; and loss may be reduced.

Figure 23:
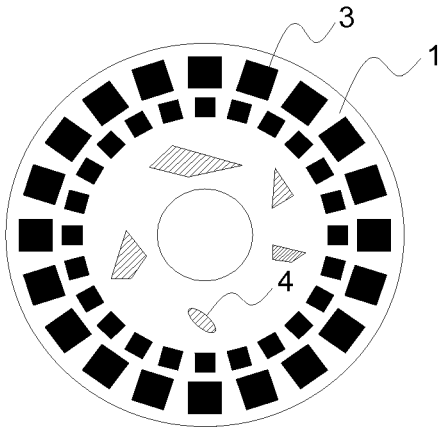
FIG. 23 is a top view of a dielectric slab according to the first embodiment of the disclosure.
Figure 24:
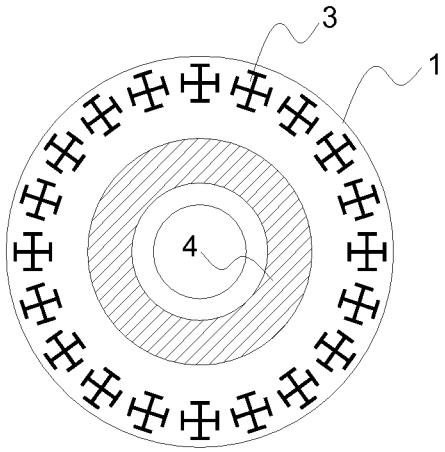
FIG. 24 is a top view of a dielectric slab according to the second embodiment of the disclosure.
Figure 25:
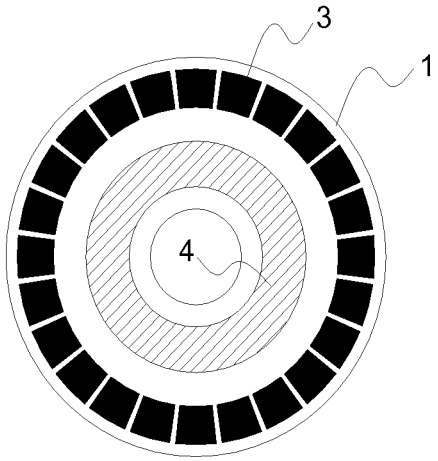
FIG. 25 is a top view of a dielectric slab according to the third embodiment of the disclosure.

The other manner is characterized in that equivalent refractive index of the artificial microstructure 3 is gradually increased along with the increase of the distance from the artificial microstructure 3 to the center of the dielectric slab 1 by facing outwards from the center of the attached dielectric slab 1 of the artificial microstructure 3 in radial direction. As the equivalent refractive index is greater, the size of the artificial microstructure is larger in a condition that the shape of the artificial microstructure 3 is not changed substantially, as illustrated in FIG. 23.

The harmonic oscillator of the conventional filter is manufactured by the microwave dielectric materials. The artificial microstructure is not arranged in the harmonic oscillator, so that the harmonic oscillator is not cut into a plurality of dielectric slabs and the problem of bonding the dielectric slabs is not generated. In order to realize the reduction of the resonant frequency of the filter, the artificial microstructure is processed in the conventional harmonic oscillator, so that the conventional harmonic oscillator is cut into a plurality of dielectric slabs; and the artificial microstructures are processed on the dielectric slabs, but the bonding process of the dielectric slabs with the artificial microstructures is a problem to be solved.

Consequently, as illustrated in FIG. 22, the invention key point of the disclosure is characterized in that the dielectric slab 1 with the artificial microstructure and the adjacent other dielectric slab 1 are connected by means of the bonding layer which is formed by the bonding agents. The bonding layer does not cover the artificial microstructure; and preferably, the bonding layer is not even contacted with the artificial microstructure 3.

As illustrated in FIG. 22 and FIG. 27, the bonding layer covers the whole or partial region except the artificial microstructure between the two adjacent dielectric slabs. It should be noted that the artificial microstructure in the disclosure is not covered in two conditions as follows: the bonding layer covers part of the artificial microstructure and completely covers no part of the artificial microstructure. If the partial covering is formed by a small amount of bonding agent is coated or squeezed on part of the surface of the artificial microstructure due to the defects of the art or other reasons, the technical solution and the technical purpose are the same or similar to the disclosure and exist in the projection range of the disclosure. Consequently, the meaning of not covering the artificial microstructure in the disclosure is understood as incompletely covering all the artificial microstructures between two adjacent dielectric slabs.

Meanwhile, the covering of the artificial microstructure means that an barrier is formed by the bonding agent between the artificial microstructure and the other dielectric slab. If the formed barrier of the bonding agent is located on one side of the artificial microstructure and only contacted with the artificial microstructure edge, the barrier also belongs to the projection range of the disclosure.

In the harmonic oscillator illustrated in FIG. 22, the artificial microstructure 3 is arranged between any adjacent dielectric slabs 1 and bonded by the bonding layer 4. The form of the bonding layer 4 may be point-shaped and plane-shaped. The bonding agent 4 illustrated in FIG. 23 is point-shaped and provided with a plurality of bonding points. Each bonding point is provided with a predetermined volume amount of bonding agent. The predetermined volume amount may ensure that the usage amount of the bonding agent in all the bonding points is not coated on the artificial microstructure after being squeezed and cured to be the bonding agent layer.

Figure 26:
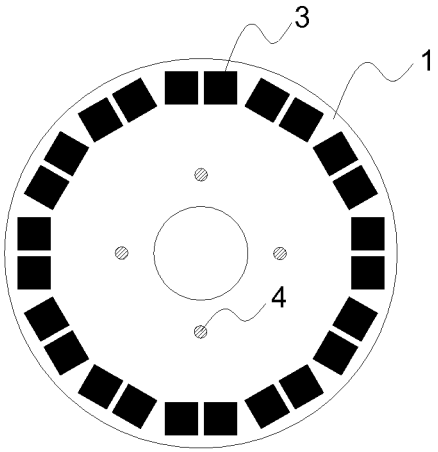
FIG. 26 is a top view of a dielectric slab according to the fourth embodiment of the disclosure.

The bonding points illustrated in FIG. 23 are randomly distributed. Preferably, four bonding points illustrated in FIG. 26 are symmetrically distributed on the surface of one dielectric slab 1 of two adjacent dielectric slabs. The plane-shaped bonding agent 4 is more capable of ensuring the firmness of bonding due to the greater area. Consequently, the bonding layer is a bonding tape or a bonding ring preferably. The bonding ring is shaped as a ring with common center line with the ring-shaped dielectric slab illustrated in FIG. 24 and FIG. 25; and the bonding ring is fully paved on the predetermined area between two adjacent dielectric slabs. Certainly, the bonding ring 4 also may be of other regular or irregular shapes.

The bonding layer 4 illustrated in FIG. 22-FIG. 26 is arranged in the artificial microstructure 3. Certainly, the bonding layer also may be arranged on the surface of the dielectric slab 1 on the periphery of the artificial microstructure 3, illustrated in FIG. 27.

In addition, the thickness of the bonding layer 4 is greater than or equal to the thickness of the artificial microstructure 3 and ensures that the bonding agent of the bonding layer 4 is not coated on the artificial microstructure 3 after being heated, squeezed or cured. As illustrated in FIG. 22, the thickness of the bonding layer 4 is greater than the thickness of the artificial microstructure 3. As illustrated in FIG. 27, the thickness of the bonding layer is equal to the thickness of the artificial microstructure 3. Obviously, the thickness of the bonding layer 4 may not be less than the thickness of the artificial microstructure 3, or the role of bonding two adjacent dielectric slabs is not played.

In order to reduce the effect on the loss of the harmonic oscillator due to the bonding agent as much as possible, the material with a low dielectric constant and a small loss angle tangent value is preferably used. Consequently, the bonding agent with a dielectric constant of 1-5 and a loss angle tangent value of 0.0001-0.1 is used, preferably, the dielectric constant is 1-3.5 and the loss angle tangent value is 0.0001-0.005. The dielectric constant of the bonding agent used in the current market is 2-3.5 in general and the loss angle tangent value is 0.0001-0.006. By means of the artificial microstructure 3 attached on the dielectric slab 1, the dielectric constant of the harmonic oscillator may be increased and the resonant frequency of the resonant cavity may be reduced, so that the size of the resonant cavity is reduced. Meanwhile, the bonding layer of the bonding agent is not coated on the artificial microstructure, the introduced loss is low and the Q value is high, thereby being good for the performance requirement of the resonant cavity.

The disclosure also relates to a resonant cavity, including a cavity and a harmonic oscillator which is illustrated in preceding text and arranged in the cavity. In the cavity, a support base is arranged at the bottom surface of the inner wall of the cavity in general to support the harmonic oscillator. The plane connected between the harmonic oscillator and the support base also may be provided with the artificial microstructure. When the harmonic oscillator is bonded with the support base, the bonding layer formed by the bonding agent is not coated on the surface of the artificial microstructure preferably.

The advantages of the harmonic oscillator of the disclosure are illustrated with reference to the application environment which is the resonant cavity of the harmonic oscillator as follows.

The harmonic oscillator illustrated in FIG. 22 is put into the cavity to form a resonant cavity; and a simulation test is performed on the resonant cavity. The simulation conditions are as follows:

As illustrated in FIG. 22, five same ring-shaped dielectric slabs 1 are stacked in turn. The artificial microstructure 3 and the bonding layer 4 are arranged between any two adjacent dielectric slabs 1. Each dielectric slab 1 has an inner diameter of 6 mm, an external diameter of 26 mm and a thickness of 1 mm. The artificial microstructure on each dielectric slab 1 is distributed to enclose a circle in uniform and ring-shaped array, as illustrated in FIG. 26. The bonding layer is formed by four symmetrical bonding points illustrated in FIG. 26. Each bonding point is shaped as a disc with a diameter of 1 mm.

Figure 28:
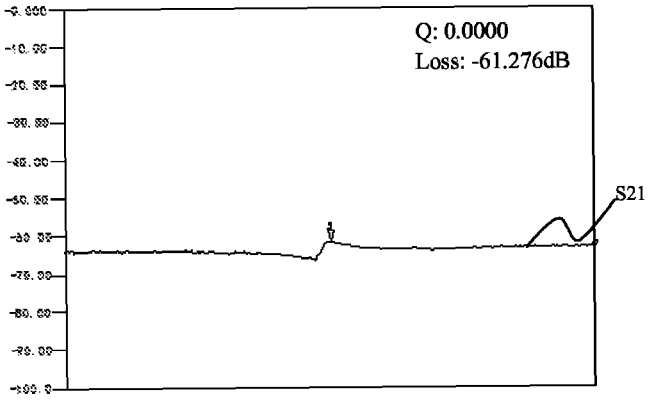
FIG. 28 is a test result diagram of an example of the harmonic oscillator in a cavity.
Figure 29:
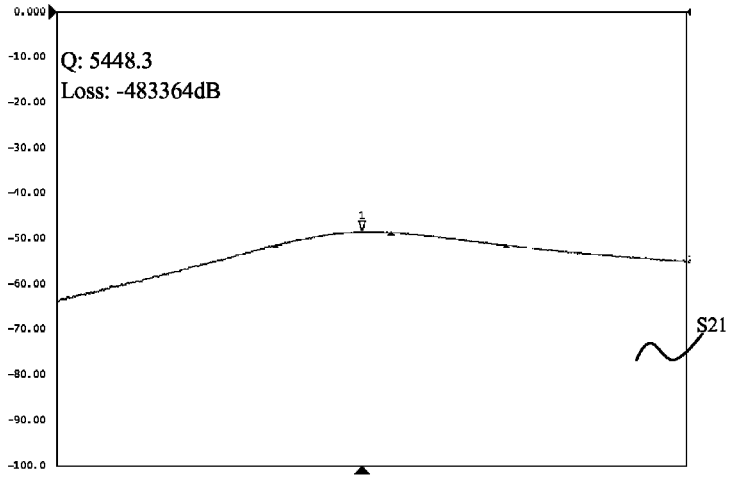
FIG. 29 is a test result diagram of the harmonic oscillator of the disclosure in the cavity.

FIG. 29 is the test result diagram of the harmonic oscillator put in the cavity. FIG. 28 is the test result diagram of the harmonic oscillator put in the cavity similarly when the whole surface of the dielectric slab attached by the artificial microstructure is fully coated by the bonding agent.

As illustrated in FIG. 29, the performance of the resonant cavity is not affected when the surface of the artificial microstructure is not coated by the bonding agent, and the Q value reaches up to 5448.3. Meanwhile, the attached drawing illustrated in FIG. 27 shows that the Q value is 0 when the bonding agent is coated on the surface of the artificial microstructure, namely the Q value is not tested. Consequently, the oscillator mode is not stimulated and the function of the resonant cavity is not realized.

Figure 30:
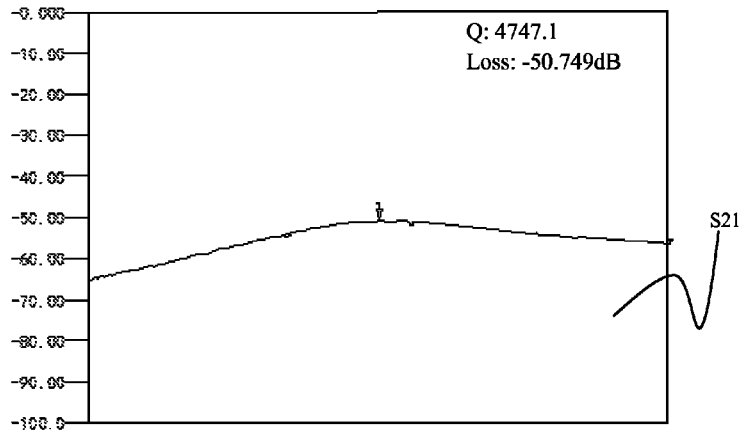
FIG. 30 is a test result diagram of the other harmonic oscillator of the disclosure in the cavity.

FIG. 30 is the test result diagram after the area of the bonding point is increased to be an area with a diameter of 4 mm. The test result of the FIG. 30 shows that the Q value is reduced to be 4747.1 after the usage amount of the bonding agent is increased. Consequently, the bonding agent is coated as less as possible in a condition that the bonding degree is ensured so as to prevent from increasing the loss of the harmonic oscillator.

On the basis of the above harmonic oscillator, the disclosure also relates to three methods for preparing the above harmonic oscillator.

Method I:

The method includes the following steps:

a, processing at least one artificial microstructures on surfaces of at least one dielectric slab;

b, putting bonding agents on surfaces of the dielectric slabs on which the artificial microstructures are attached and obtaining at least one metamaterial slab, where the bonding agents are not coated on the at least one artificial microstructure and c, stacking another dielectric slab on the metamaterial slab obtained in the step b, disposing the at least one artificial microstructure between the two dielectric slabs and bonding the two dielectric slabs by the bonding agents to form a bonding layer.

The above method relates to the condition that the harmonic oscillator has two dielectric slabs. When a plurality of dielectric slabs is arranged and the each artificial microstructure is arranged on each dielectric slab, in the step a, a plurality of dielectric slabs is predetermined; and the each artificial microstructure is processed on the surface of each dielectric slab; in the step b, the bonding agents are placed on the surfaces of the artificial microstructures attached on each dielectric slab respectively; the bonding agents are not coated on the artificial microstructures; and a plurality of metamaterial slabs is obtained and is stacked in the same direction in turn; and in the step c, the other dielectric slab is stacked on the stacked metamaterial slab obtained in the step b, so that the artificial microstructures on the metamaterial slab at the outermost end are located between the dielectric slab of the metamaterial slab and the another dielectric slab; two adjacent dielectric slabs are connected through the bonding agents; and the bonding layers are formed by the bonding agents. When the two dielectric slabs are bonded by the bonding agent, the two dielectric slabs are preferably pressed or heated, so that the bonding agent is cured to form the bonding layer.

The bonding agents are dispersed on the surfaces of the dielectric slabs through a glue dispersing machine; and bonding points are formed respectively by the bonding agents of the points. The bonding agents are randomly or symmetrically distributed on the surfaces of the dielectric slabs. Certainly, the bonding agents are coated on the surfaces of the dielectric slabs in a shape of ring. The bonding ring is of irregular shape or symmetrical ring shape, preferably symmetric ring shape. More preferably, the dielectric slabs are ring-shaped; and the bonding ring is shaped as a ring with a common center line of the dielectric slabs.

The manner of processing the artificial microstructure includes steps of plating a conductive material layer on the surface of the dielectric slab and then etching the conductive material layer so as to obtain a certain geometric figure.

The predetermined volume amount is less than the product of the area of the surface with the artificial microstructure and the predetermined thickness of the bonding agents. The predetermined thickness of the bonding layers is greater than or equal to the thickness of the artificial microstructures. The selection of the bonding agent is illustrated in the preceding text and not illustrated again in the part.

In the method I, the artificial microstructure and the bonding agent are arranged on the same surface of one dielectric slab and then bonded. Obviously, the artificial microstructure and the bonding agent are arranged on two dielectric slabs respectively in turn and then bonded. Consequently, the disclosure also relates to another method for preparing the harmonic oscillator.

Method II:

The method includes the following steps:

a, processing at least one artificial microstructure on a surface of a at least one dielectric slab, where each artificial microstructure is structures manufactured by conductive material and provided with geometric figures;

b, placing bonding agents on the surface of the another dielectric slab; and c, bonding the dielectric slab obtained in the step a with the dielectric slab obtained in the step b, the artificial microstructure between the two dielectric slabs, wherein the bonding agents are not coated on the artificial microstructure, and the two dielectric slabs are bonded by the bonding agents to form a bonding layer.

The manner for processing the artificial microstructures, the manner of arranging the bonding agent on the surface of the dielectric slab, the volume amount, the manner of forming the bonding layer and another predicated content are the same as the description of the preceding text.

When a plurality of dielectric slabs of the harmonic oscillator is arranged, the artificial microstructure and the bonding agent are arranged on two surfaces of the same dielectric slab respectively and then bonded in turn. Consequently, the invention also relates to a third method for preparing the above harmonic oscillator.

Method III:

The method includes the following steps:

a, processing at least one artificial microstructure on one surface of a at least one dielectric slab, where each artificial microstructure is structures manufactured by conductive material and provided with geometric figures;

b, placing a bonding agent on the another surface of the dielectric slab, where the projection of the bonding agent on the surface with the each artificial microstructure is staggered and not coincided with the each artificial microstructure;

c, repeating the step a and the step b in turn to prepare a plurality of dielectric slabs with the each artificial microstructure on one surface and the bonding agents on the another surface; and d, stacking the plurality of dielectric slabs obtained in the step c in the same direction in turn, where two adjacent dielectric slabs are bonded by means of the bonding agents; the each artificial microstructure is located between two dielectric slabs; the bonding agents are not coated on the artificial microstructures; and the two adjacent dielectric slabs are bonded by the bonding agents to form a bonding layer.

In the same way, content for processing the artificial microstructures and arranging the bonding agents and the like in the above method are the same or similar to the corresponding description of the preceding text.

In the step d, a plurality of dielectric slabs obtained in the step c is stacked in the same direction in turn, so that the bonding agent is arranged on the external surface of one of the two dielectric slabs at the outermost end; the each artificial microstructure is arranged on the external surface of the another dielectric slab; and a dielectric slab with the artificial microstructures and a dielectric slab with the bonding agents are bonded on the external surfaces of the two dielectric slabs at the outermost end respectively, so that two end surfaces at the outermost end of the harmonic oscillator formed finally are smooth dielectric slab surfaces.

Based on the characteristics of the single cavity of the resonant cavity, the disclosure also relates to a filtering device. The filtering device may be filter, such as a band-pass filter, band-block filter, a high-pass filter, a low-pass filter or a multi-band filter; the filtering device also may be a duplexer or a device with function of filtering. The filtering device includes at least one resonant cavity which is the resonant cavity with the above harmonic oscillator. The filtering device in the disclosure is a cavity filter in particular.

Further, the disclosure also relates to a microwave device with the filtering device. The microwave device may be any devices with the need of the filtering device, such as the aircraft, the radar, the base station, the satellite and the like. The microwave device is capable of receiving and sending signals as well as filtering after receiving or before sending, so that the received or sent signals meet the requirements. Consequently, the microwave device at least also includes a signal sending module connected with the input end of the filtering device and a signal receiving module connected with the output end of the filtering device.

Figure 31:
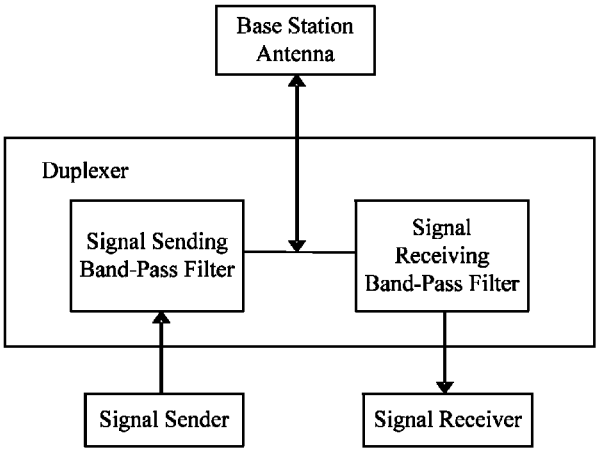
FIG. 31 is a schematic diagram of a local structure when the microwave device of the disclosure is a base station.

For example, as illustrated in FIG. 31, the microwave device is a base station. The base station includes a duplexer used as the filtering device. The duplexer includes a signal sending band-pass filter and a signal receiving filter. The input end of the signal sending band-pass filter is connected with a signal sender, and the output end thereof is connected with a base station antenna; and the input end of the signal receiving band-pass filter is connected with the base station antenna, and the output end thereof is connected with the signal receiver.

On account of the signal sending band-pass filter, the signal sending module is the signal sender; and the signal receiving module is the base station antenna. On account of the signal receiving band-pass filter, the signal sending module is the base station antenna; and the signal receiving module is the signal receiver. At least one of the signal sending band-pass filter and the signal receiving band-pass filter is the cavity filter with the harmonic oscillator of the disclosure. By using the duplexer, a size of the resonant cavity and the duplexer may be greatly reduced. Meanwhile, the duplexer is good in electric performance. The loss is low in particular, thereby being good for the miniaturization of the base station. Another microwave devices are also capable of realizing the miniaturization effect.

In conclusion, by using the harmonic oscillator of the disclosure, the bonding agent is not coated on the artificial microstructure. By using the artificial microstructure, not only the equivalent dielectric constant of the harmonic oscillator is improved, but also the resonant frequency of the harmonic oscillator is reduced, meanwhile, the problem that the loss is severely affected and the Q value of the harmonic oscillator is greatly reduced when the dielectric is cut into dielectric slabs due to the processing of the artificial microstructure is solved, so that the harmonic oscillator with high dielectric constant and high Q value. When the harmonic oscillator is used in the resonant cavity, the size of the resonant cavity is greatly reduced in a condition that the same resonant frequency is realized, thereby being good for the miniaturization of the filtering device and the microwave device. The embodiments of the disclosure are illustrated in the preceding text by combining the attached drawings, but the disclosure is not limited by the embodiments. The above embodiments are only schematic and not restrictive. The common staffs skilled in the art also can make a plurality of forms belonging to the projection of the disclosure in a condition of not separating from the purpose of the disclosure and the range protected by the claims.

What is claimed is:

1. A harmonic oscillator, comprising:

at least one dielectric slab; and at least one response unit attached on the edge of a surface of the at least one dielectric slab;

wherein the at least one response unit presents positive equivalent refractive index in an electromagnetic field corresponding to a working frequency of the harmonic oscillator; and the response unit is a structure manufactured by conductive material and provided with geometric patterns;

wherein there are a plurality of response units, and the plurality of response units is attached on the at least one dielectric slab and not electrically connected with each other; and the equivalent refractive index and a size of different response units on each dielectric slab are increased along with the increase of a distance from the different response units to a center point on the surface of the dielectric slab.

2. The harmonic oscillator according to claim 1, wherein there are a plurality of dielectric slabs, and the harmonic oscillator comprises a plurality of dielectric slabs stacked in turn; and the at least one response unit is attached on one or more dielectric slabs located at both ends of the stacked harmonic oscillator.

3. The harmonic oscillator according to claim 1, wherein a working frequency of the harmonic oscillator is greater than a plasma frequency of the response unit or less than a high-order resonant frequency after the plasma frequency; a size of the response unit is less than 50% or 20% of a wavelength of an electromagnetic wave corresponding to a working frequency of the harmonic oscillator.

4. The harmonic oscillator according to claim 1, wherein the at least one dielectric slab is manufactured by material with a dielectric constant greater than 1 and a loss angle tangent value less than 0.1; or the at least one dielectric slab is manufactured by material with a dielectric constant greater than 30 and a loss angle tangent value less than 0.01.

5. The harmonic oscillator according to claim 1, wherein there are a plurality of response units, each of the plurality of response unit is an anisotropic structure, and the plurality of response units are arranged and distributed on the at least one dielectric slab in a manner of ring array or rectangular array.

6. The harmonic oscillator according to claim 1, wherein there are a plurality of response units, each response unit is net-shaped and comprises one metal sheet, and a plurality of holes is hollowed on the metal sheet; or each response unit is a fan-shaped metal sheet, and a plurality of the fan-shaped metal sheets is arranged as a circumference by taking one point as a circle center; or the response unit presents square, two square response units are arranged with intervals side by side to form one response unit pair, and a plurality of response unit pairs is arranged as a circumference by taking one point as a circle center.

7. The harmonic oscillator according to claim 1, wherein there are a plurality of dielectric slabs, and the at least one response unit is at least one artificial microstructure; the harmonic oscillator comprises two or more dielectric slabs stacked in turn; the artificial microstructure is arranged between at least two adjacent dielectric slabs of the dielectric slabs; the two adjacent dielectric slabs are connected through a bonding layer; the artificial microstructure is not covered by the bonding layer; and the artificial microstructure is a structure manufactured by conductive material and provided with geometric figure; or the artificial microstructure is arranged between each two adjacent dielectric slabs, each two adjacent dielectric slabs are bonded through the bonding layer; a thickness of the bonding layer is greater than or equal to a thickness of the artificial microstructure; and the surface of the corresponding artificial microstructure is not covered by the bonding layer.

8. The harmonic oscillator according to claim 7, wherein the at least one dielectric slab presents ring-shaped, and the artificial microstructures are arranged in a ring-shaped array by taking a circle center of the surface of the at least one dielectric slab as a rotation center; or the at least one dielectric slab presents square, and the artificial microstructures are arranged in a rectangular array by taking a length side or a width side of the dielectric slab as a row direction and a line direction respectively.

9. The harmonic oscillator according to claim 7, wherein a dielectric constant of bonding agents of the bonding layer is 1-5, and a loss angle tangent value is 0.0001-0.1; or a dielectric constant of the bonding agents of the bonding layer is 1-3.5, and a loss angle tangent value is 0.0001-0.05; or a dielectric constant of the bonding agents of the bonding layer is 2-3.5, and a loss angle tangent value is 0.0001-0.006.

10. The harmonic oscillator according to claim 1, wherein the at least one dielectric slab is at least one substrate; the at least one response unit is at least one artificial microstructure; the harmonic oscillator comprises a plurality of harmonic oscillator sheet layers with through holes and also comprises a connection part penetrated through the through hole of each of the harmonic oscillator sheet layers in turn to string the plurality of harmonic oscillator sheet layers together; the harmonic oscillator sheet layer comprises a substrate and at least one artificial microstructure attached on the substrate; each artificial microstructure is a plane structure manufactured by conductive material and provided with geometric figures; and the connection part comprises a bolt penetrated through the through holes and a nut connected to the end of the bolt; and the nut and the bolt are fixedly connected together by welding or hot pressing.

11. The harmonic oscillator according to claim 1, wherein the at least one dielectric slab is at least one substrate; the at least one response unit is at least one artificial microstructure; the harmonic oscillator comprises a dielectric body and a support base positioned at the bottom of the dielectric body; the dielectric body comprises a plurality of harmonic oscillator sheet layers with through holes and a connection part penetrated through the through holes of each of the harmonic oscillator sheet layers in turn and connected with the support base so as to fixedly connect the dielectric body and the supporting base integrally; the harmonic oscillator sheet layer comprises a substrate and at least one artificial microstructure attached on the substrate; and each artificial microstructure is a plane structure manufactured by conductive material and provided with geometric figures; and the connection part is manufactured by a material with a dielectric constant less than 10 and a loss angle tangent value less than 0.1.

12. The harmonic oscillator according to claim 11, wherein the support base is provided with a thread hole, the connection part is a bolt, and the bolt is penetrated through the through holes of each of the harmonic oscillator sheet layers, assembled and locked with the thread hole of the support base; or the support base is provided with a through hole, the connection part comprises a bolt and a nut, and the bolt is assembled and locked with the nut after penetrating through the harmonic oscillator sheet layers and the through hole of the support base in turn.

13. The harmonic oscillator according to claim 11, wherein each of the harmonic oscillator sheet layers takes a shape of ring with a through hole in the middle; the plurality of harmonic oscillator sheet layers is the same in shape and is stacked in turn to form a shape of a hollow cylinder.

14. The harmonic oscillator according to claim 11, wherein there are a plurality of artificial microstructures, and the plurality of artificial microstructures is arranged in pairs; each of the artificial microstructure pairs is uniformly distributed by taking a circle center of the ring-shaped harmonic oscillator sheet layer surface as a circle center; each of the artificial microstructure pairs comprises two identical artificial microstructures arranged in parallel; and the artificial microstructure is a solid metal foil or a hollow metal foil with a plurality of holes.

15. A method for preparing the harmonic oscillator according to claim 1, the method comprising:

a, processing at least one artificial microstructure on a surface of one or more dielectric slabs, wherein each artificial microstructure is a structure manufactured by conductive material and provided with geometric figures;

b, putting bonding agents on the surface of the at least one dielectric slab on which the at least one artificial microstructure is attached and obtaining at least one metamaterial slab, wherein the bonding agents are not coated on the at least one artificial microstructure;

c, stacking another dielectric slab on the metamaterial slab obtained in the step b, disposing the at least one artificial microstructure between the two dielectric slabs and bonding the two dielectric slabs by the bonding agents to form a bonding layer; or bonding the dielectric slab obtained in the step a with the dielectric slab obtained in the step b, disposing the artificial microstructures between the two dielectric slabs, wherein the bonding agents are not coated on the artificial microstructures, and the two dielectric slabs are bonded by the bonding agents to form a bonding layer.

16. The method according to claim 15, wherein in the step a, there are a plurality of dielectric slabs, the number of the plurality of dielectric slabs is a predetermined value, and the at least one artificial microstructure is processed by plating a conductive material layer on the surface of the dielectric slab and then etching the conductive material layer;

in the step b, the bonding agents are placed on the surface of each of the dielectric slabs on which the at least one artificial microstructure is attached respectively, the bonding agents are not coated on the artificial microstructures, and a plurality of metamaterial slabs is obtained and is stacked in the same direction in turn;

in the step c, another dielectric slab is stacked on the at least one metamaterial slab obtained in the step b, so that the at least one artificial microstructure on the metamaterial slab at the outermost end is located between the metamaterial slab and the another dielectric slab, two adjacent dielectric slabs are connected through the bonding agents, and the bonding layers are formed by the bonding agents.

17. A filtering device, wherein the filtering device comprises at least one resonant cavity and at least one harmonic oscillator positioned in the at least one resonant cavity; and the harmonic oscillator is the harmonic oscillator according to claim 1.

18. The filtering device according to claim 17, wherein the filtering device is a cavity filter; and the cavity filter is a band-pass filter, a band stop filter, a high-pass filter, a low-pass filter or a multi-band filter; a first mode of the cavity filter is a TE mode; and the at least one response unit is arranged on a plane parallel to a electric field of the TE mode.

19. The filtering device according to claim 18, wherein the at least one response unit of the harmonic oscillator is located on a partial region on the surface of the dielectric slab to which the response unit is attached; a component of magnetic fields at various points in the partial region along the surface of the dielectric slab is less than a predetermined value; and the partial region on the surface of the dielectric slab is located on the edge of the surface of the dielectric slab.

* * * * *